US008825477B2

(12) United States Patent
Krishnan et al.

(10) Patent No.: US 8,825,477 B2
(45) Date of Patent: Sep. 2, 2014

(54) SYSTEMS, METHODS, AND APPARATUS FOR FRAME ERASURE RECOVERY

(75) Inventors: Venkatesh Krishnan, San Diego, CA (US); Ananthapadmanabhan Arasanipatai Kandhadai, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 890 days.

(21) Appl. No.: 12/966,960

(22) Filed: Dec. 13, 2010

(65) Prior Publication Data

US 2011/0082693 A1 Apr. 7, 2011

Related U.S. Application Data

(63) Continuation of application No. 11/868,351, filed on Oct. 5, 2007, now Pat. No. 7,877,253.

(60) Provisional application No. 60/828,414, filed on Oct. 6, 2006.

(51) Int. Cl.
*G10L 19/14* (2006.01)

(52) U.S. Cl.
USPC ..... 704/225; 704/201; 704/208; 704/210; 704/223

(58) Field of Classification Search
CPC ..... G10L 19/00; G10L 19/005; G10L 19/008; G10L 21/00; G10L 21/02; G10L 25/78; G10L 25/93; G10L 2019/0001; G10L 2019/0003; G10L 19/28; G10L 19/22
USPC ..... 704/225, 201, 223, 208, 210
See application file for complete search history.

(56) References Cited

U.S. PATENT DOCUMENTS

| | | | | |
|---|---|---|---|---|
| 5,414,796 | A | 5/1995 | Jacobs et al. | |
| 5,699,485 | A | 12/1997 | Shoham | |
| 5,960,386 | A | 9/1999 | Janiszewski et al. | |
| 6,014,622 | A | 1/2000 | Su et al. | |
| 6,085,158 | A | 7/2000 | Naka et al. | |
| 6,691,092 | B1 * | 2/2004 | Udaya Bhaskar et al. | 704/265 |
| 6,810,377 | B1 | 10/2004 | Ho et al. | |
| 7,406,411 | B2 | 7/2008 | Chen | |

(Continued)

FOREIGN PATENT DOCUMENTS

| | | | |
|---|---|---|---|
| EP | 1577881 | A2 | 9/2005 |
| JP | 5113800 | A | 5/1993 |

(Continued)

OTHER PUBLICATIONS

European Search Report—EP11175820—Search Authority—Munich—Apr. 2, 2012.

(Continued)

*Primary Examiner* — Qi Han
(74) *Attorney, Agent, or Firm* — Heejong Yoo

(57) ABSTRACT

In one configuration, erasure of a significant frame of a sustained voiced segment is detected. An adaptive codebook gain value for the erased frame is calculated based on the preceding frame. If the calculated value is less than (alternatively, not greater than) a threshold value, a higher adaptive codebook gain value is used for the erased frame. The higher value may be derived from the calculated value or selected from among one or more predefined values.

15 Claims, 31 Drawing Sheets

(56) References Cited

U.S. PATENT DOCUMENTS

| | | | | |
|---|---|---|---|---|
| 7,877,253 | B2 | 1/2011 | Krishnan et al. | |
| 2002/0123887 | A1 | 9/2002 | Unno | |
| 2003/0036901 | A1 | 2/2003 | Chen | |
| 2003/0078769 | A1 | 4/2003 | Chen | |
| 2003/0093746 | A1 | 5/2003 | Kang et al. | |
| 2005/0154584 | A1 * | 7/2005 | Jelinek et al. | 704/219 |
| 2008/0235554 | A1 | 9/2008 | Simmons et al. | |

FOREIGN PATENT DOCUMENTS

| | | | |
|---|---|---|---|
| JP | 7092999 | A | 4/1995 |
| JP | 8500235 | A | 1/1996 |
| JP | 9101800 | A | 4/1997 |
| JP | 10187196 | A | 7/1998 |
| JP | 2002268696 | A | 9/2002 |
| JP | 2005316497 | A | 11/2005 |
| RU | 2130693 | | 5/1999 |
| TW | 200532646 | | 10/2005 |
| TW | 200534599 | | 10/2005 |
| WO | WO9429851 | A1 | 12/1994 |
| WO | WO2005117366 | A1 | 12/2005 |
| WO | WO2007099244 | A2 | 9/2007 |

OTHER PUBLICATIONS

3rd Generation Partnership Project 2 ("3GPP2"), Enhanced Variable Rate Codec, Speech Service Option 3, 68 and 70 for Wideband Spread Spectrum Digital Systems, 3GPP2 C.S0014-C, ver. 1.0, Jan. 2007, § 4.11.5 to 4.11.5.3, pp. 4-91 to 4-94.

3rd Generation Partnership Project 2 ("3GPP2"), Enhanced Variable Rate Codec, Speech Service Option 3 for Wideband Spread Spectrum Digital Systems, 3GPP2 C.S0014-A, ver. 1.0, Apr. 2004, Ch. 5, pp. 5-1 to 5-12.

3rd Generation Partnership Project 2 (3GPP2), "Enhanced Variable Rate Codec, Speech Service Options 3, 68, and 70 for Wideband Spread Spectrum Digital Systems," 3GPP2 C.S0014-C, Version 1.0, Jan. 2007, Ch. 5, pp. 5-1 to 5-42.

3rd Generation Partnership Project 2 ("3GPP2"), Selectable Mode Vocoder (SMV) Service Option for Wideband Spread Spectrum Communication Systems, 3GPP2 C.S0030-0, ver. 3.0, Jan. 2004, Ch. 6.8 thru 6.9, pp. 197-203.

Dorot, V., et al., Tolkovy Slovar Sovremennoy Komp'yuternoy Leksiki (The Explanatory Dictionary for Modern Computer Vocabulary), 2nd edition, BHV-Petersburg Publishers, Saint-Petersburg, 2001, p. 339.

ETSI TS 126 090, Digital Cellular telecommunications system (Phase 2+); Universal Mobile Telecommunications System (UMTS); AMR speech Codec; Transcoding Functions (3GPP TS 26.090, version 6.0.0, Release 6), Dec. 2004, Ch. 4, pp. 12-16.

ETSI TS 126 090, Digital Cellular telecommunications system (Phase 2+); Universal Mobile Telecommunications System (UMTS); AMR speech Codec; Transcoding Functions (3GPP TS 26.090, version 6.0.0, Release 6), Dec. 2004, Ch. 5, pp. 16-39.

ETSI TS 126 090, Digital Cellular telecommunications system (Phase 2+); Universal Mobile Telecommunications System (UMTS); AMR speech Codec; Transcoding functions (3GPP TS 26.090, version 6.0.0, Release 6), Dec. 2004, Ch. 6, pp. 40-44.

ETSI TS 126 192, Digital Cellular telecommunications system (Phase 2+); Universal Mobile Telecommunications System (UMTS); AMR speech Codec (3GPP TS 26.192, version 6.0.0, Release 6), Dec. 2004, Ch. 1-7, pp. 1-14.

ETSI TS 126 290, Digital Cellular telecommunications system (Phase 2+); Universal Mobile Telecommunications System (UMTS); Audio codec processing functions; Extended Adaptive Multi-Rate—Wideband (AMD-WB+) codec; Transcoding functions (3GPP TS 26.290 version 6.3.0, Release 6), Jun. 2005, Ch. 6, pp. 53-72.

International Preliminary Report on Patentability—PCT/US07/080653, The International Bureau of WIPO—Gneva Switzerland—Apr. 7, 2009.

International Search Report—PCT/US07/080653, International Search Authority—European Patent Office—Feb. 29, 2008.

International Telecommunication Union, ITU-T, Telecommunication Standardization Sector of ITU; G.722.2, Appendix I; Wideband Coding of speech at around 16 kbit/s using Adaptive Multi-Rate Wideband (AMR-WB), Appendix I, Error concealment of erroneous or lost frames, Jan. 2002, pgs. title, forward, 1-9.

International Telecommunication Union, ITU-T, Telecommunication Standardization Sector of ITU; G.722.2; Wideband Coding of speech at around 16 kbit/s using Adaptive Multi-Rate Wideband (AMR-WB), Jul. 2003, Ch. 5, pp. 14-37.

International Telecommunication Union, ITU-T, Telecommunication Standardization Sector of ITU; G.722.2; Wideband coding of speech at around 16 kbit/s using Adaptive Multi-Rate Wideband (AMR-WB), Jul. 2003, Ch. 6, pp. 37-42.

International Telecommunication Union, ITU-T, Telecommunication Standardization Sector of ITU; G.728, Annex I; Coding of speech at around 16 kbit/s using low-delay code excited linear prediction, Annex I: Frame or packet loss concealment for the LD-CELP, Mar. 1999, pgs. title forward, 1-19.

International Telecommunication Union, ITU-T, Telecommunication Standardization Sector of ITU; G.729; Coding of speech at 8 kbit/s using conjugate-structure algebraic-code-excited linear-prediction (CS-ACELP), Mar. 1996, Ch. 4, pp. 25-32.

Rabiner, et al., Digital Processing of Speech Signals; Prentice-Hall signal processing series, ISBN 0-13-21360-1, 1978, pp. 396-453.

Taiwanese Search report—096137743—TIPO—Jan. 4, 2011.

TIA/EIA/IS-127, Enhanced Variable Rate Codec, Speech Service Option 3 for Wideband Spread Spectrum Digital Systems, Jan. 1997, Ch. 4, pp. 4-1 thru 4-62.

TIA/EIA/IS-127, Enhanced Variable Rate Codec, Speech Service Option 3 for Wideband Spread Spectrum Digital Systems, Jan. 1997, Ch. 5, pp. 5-1 thru 5-14.

Translation of Office Action in Taiwan application 096137743 corresponding to U.S. Appl. No. 12/966,960, citing EP1577881, US20030036901, US6085158, US5699485, US20030078769, TW200532646 and TW200534599 dated Feb. 22, 2011.

Written Opinion—PCT/US07/080653, International Search Authority—European Patent Office—Feb. 29, 2008.

* cited by examiner method M180

SYSTEMS, METHODS, AND APPARATUS FOR FRAME ERASURE RECOVERY

CLAIM OF PRIORITY UNDER 35 U.S.C. §120

The present Application for Patent is a continuation of U.S. patent application Ser. No. 11/868,351 entitled "SYSTEMS, METHODS, AND APPARATUS FOR FRAME ERASURE RECOVERY" filed Oct. 5, 2007, pending, which claims priority to Provisional Application U.S. Provisional Patent Application Ser. No. 60/828,414, "SYSTEMS, METHODS, AND APPARATUS FOR FRAME ERASURE RECOVERY" filed Oct. 6, 2006, and assigned to the assignee hereof and hereby expressly incorporated by reference herein.

FIELD

This disclosure relates to processing of speech signals.

BACKGROUND

Transmission of audio, such as voice and music, by digital techniques has become widespread, particularly in long distance telephony, packet-switched telephony such as Voice over IP (also called VoIP, where IP denotes Internet Protocol), and digital radio telephony such as cellular telephony. Such proliferation has created interest in reducing the amount of information used to transfer a voice communication over a transmission channel while maintaining the perceived quality of the reconstructed speech. For example, it is desirable to make the best use of available wireless system bandwidth. One way to use system bandwidth efficiently is to employ signal compression techniques. For wireless systems which carry speech signals, speech compression (or "speech coding") techniques are commonly employed for this purpose.

Devices that are configured to compress speech by extracting parameters that relate to a model of human speech generation are often called vocoders, "audio coders," or "speech coders." An audio coder generally includes an encoder and a decoder. The encoder typically divides the incoming speech signal (a digital signal representing audio information) into segments of time called "frames," analyzes each frame to extract certain relevant parameters, and quantizes the parameters into an encoded frame. The encoded frames are transmitted over a transmission channel (i.e., a wired or wireless network connection) to a receiver that includes a decoder. The decoder receives and processes encoded frames, dequantizes them to produce the parameters, and recreates speech frames using the dequantized parameters.

In a typical conversation, each speaker is silent for about sixty percent of the time. Speech encoders are usually configured to distinguish frames of the speech signal that contain speech ("active frames") from frames of the speech signal that contain only silence or background noise ("inactive frames"). Such an encoder may be configured to use different coding modes and/or rates to encode active and inactive frames. For example, speech encoders are typically configured to use fewer bits to encode an inactive frame than to encode an active frame. A speech coder may use a lower bit rate for inactive frames to support transfer of the speech signal at a lower average bit rate with little to no perceived loss of quality.

Examples of bit rates used to encode active frames include 171 bits per frame, eighty bits per frame, and forty bits per frame. Examples of bit rates used to encode inactive frames include sixteen bits per frame. In the context of cellular telephony systems (especially systems that are compliant with Interim Standard (IS)-95 as promulgated by the Telecommunications Industry Association, Arlington, Va., or a similar industry standard), these four bit rates are also referred to as "full rate," "half rate," "quarter rate," and "eighth rate," respectively.

Many communication systems that employ speech coders, such as cellular telephone and satellite communications systems, rely on wireless channels to communicate information. In the course of communicating such information, a wireless transmission channel can suffer from several sources of error, such as multipath fading. Errors in transmission may lead to unrecoverable corruption of a frame, also called "frame erasure." In a typical cellular telephone system, frame erasure occurs at a rate of one to three percent and may even reach or exceed five percent.

The problem of packet loss in packet-switched networks that employ audio coding arrangements (e.g., Voice over Internet Protocol or "VoIP") is very similar to frame erasure in the wireless context. That is, due to packet loss, an audio decoder may fail to receive a frame or may receive a frame having a significant number of bit errors. In either case, the audio decoder is presented with the same problem: the need to produce a decoded audio frame despite the loss of compressed speech information. For purposes of this description, the term "frame erasure" may be deemed to include "packet loss."

Frame erasure may be detected at the decoder according to a failure of a check function, such as a CRC (cyclic redundancy check) function or other error detection function that uses, e.g., one or more checksums and/or parity bits. Such a function is typically performed by a channel decoder (e.g., in a multiplex sublayer), which may also perform tasks such as convolutional decoding and/or de-interleaving. In a typical decoder, a frame-error detector sets a frame erasure flag upon receiving an indication of an uncorrectable error in a frame. The decoder may be configured to select a frame erasure recovery module to process a frame for which the frame erasure flag is set.

SUMMARY

A method of speech decoding according to one configuration includes detecting, in an encoded speech signal, erasure of the second frame of a sustained voiced segment. The method also includes calculating, based on the first frame of the sustained voiced segment, a replacement frame for the second frame. In this method, calculating a replacement frame includes obtaining a gain value that is higher than a corresponding gain value of the first frame.

A method of obtaining frames of a decoded speech signal according to another configuration includes calculating, based on information from a first encoded frame of an encoded speech signal and a first excitation signal, a first frame of the decoded speech signal. This method also includes calculating, in response to an indication of erasure of a frame of said encoded speech signal that immediately follows said first encoded frame, and based on a second excitation signal, a second frame of said decoded speech signal that immediately follows said first frame. This method also includes calculating, based on a third excitation signal, a third frame that precedes said first frame of the decoded speech signal. In this method, the first excitation signal is based on a product of (A) a first sequence of values that is based on information from the third excitation signal and (B) a first gain factor. In this method, calculating a second frame includes generating the second excitation signal according to a relation between a threshold value and a value based on the first gain factor, such that the second excitation signal is based on a product of (A) a second sequence of values that is based on information from said first excitation signal and (B) a second gain factor greater than the first gain factor.

A method of obtaining frames of a decoded speech signal according to another configuration includes generating a first excitation signal that is based on a product of a first gain factor and a first sequence of values. This method also includes calculating, based on the first excitation signal and information from a first encoded frame of an encoded speech signal, a first frame of the decoded speech signal. This method also includes generating, in response to an indication of erasure of a frame of said encoded speech signal that immediately follows said first encoded frame, and according to a relation between a threshold value and a value based on the first gain factor, a second excitation signal based on a product of (A) a second gain factor that is greater than the first gain factor and (B) a second sequence of values. This method also includes calculating, based on the second excitation signal, a second frame that immediately follows said first frame of the decoded speech signal. This method also includes calculating, based on a third excitation signal, a third frame that precedes said first frame of the decoded speech signal. In this method, the first sequence is based on information from the third excitation signal, and the second sequence is based on information from the first excitation signal.

An apparatus for obtaining frames of a decoded speech signal according to another configuration includes an excitation signal generator configured to generate first, second, and third excitation signals. This apparatus also includes a spectral shaper configured (A) to calculate, based on the first excitation signal and information from a first encoded frame of an encoded speech signal, a first frame of a decoded speech signal, (B) to calculate, based on the second excitation signal, a second frame that immediately follows said first frame of the decoded speech signal, and (C) to calculate, based on the third excitation signal, a third frame that precedes said first frame of the decoded speech signal. This apparatus also includes a logic module (A) configured to evaluate a relation between a threshold value and a value based on the first gain factor and (B) arranged to receive an indication of erasure of a frame of the encoded speech signal that immediately follows said first encoded frame. In this apparatus, the excitation signal generator is configured to generate the first excitation signal based on a product of (A) a first gain factor and (B) a first sequence of values that is based on information from the third excitation signal. In this apparatus, the logic module is configured, in response to the indication of erasure and according to the evaluated relation, to cause the excitation signal generator to generate the second excitation signal based on a product of (A) a second gain factor that is greater than the first gain factor and (B) a second sequence of values that is based on information from the first excitation signal.

An apparatus for obtaining frames of a decoded speech signal according to another configuration includes means for generating a first excitation signal that is based on a product of a first gain factor and a first sequence of values. This apparatus also includes means for calculating, based on the first excitation signal and information from a first encoded frame of an encoded speech signal, a first frame of the decoded speech signal. This apparatus also includes means for generating, in response to an indication of erasure of a frame of said encoded speech signal that immediately follows said first encoded frame, and according to a relation between a threshold value and a value based on the first gain factor, a second excitation signal based on a product of (A) a second gain factor that is greater than the first gain factor and (B) a second sequence of values. This apparatus also includes means for calculating, based on the second excitation signal, a second frame that immediately follows said first frame of the decoded speech signal. This apparatus also includes means for calculating, based on a third excitation signal, a third frame that precedes said first frame of the decoded speech signal. In this apparatus, the first sequence is based on information from the third excitation signal, and the second sequence is based on information from the first excitation signal.

A computer program product according to another configuration includes a computer-readable medium which includes code for causing at least one computer to generate a first excitation signal that is based on a product of a first gain factor and a first sequence of values. This medium also includes code for causing at least one computer to calculate, based on the first excitation signal and information from a first encoded frame of an encoded speech signal, a first frame of the decoded speech signal. This medium also includes code for causing at least one computer to generate, in response to an indication of erasure of a frame of said encoded speech signal that immediately follows said first encoded frame, and according to a relation between a threshold value and a value based on the first gain factor, a second excitation signal based on a product of (A) a second gain factor that is greater than the first gain factor and (B) a second sequence of values. This medium also includes code for causing at least one computer to calculate, based on the second excitation signal, a second frame that immediately follows said first frame of the decoded speech signal. This medium also includes code for causing at least one computer to calculate, based on a third excitation signal, a third frame that precedes said first frame of the decoded speech signal. In this product, the first sequence is based on information from the third excitation signal, and the second sequence is based on information from the first excitation signal.

DETAILED DESCRIPTION

Figure 1:
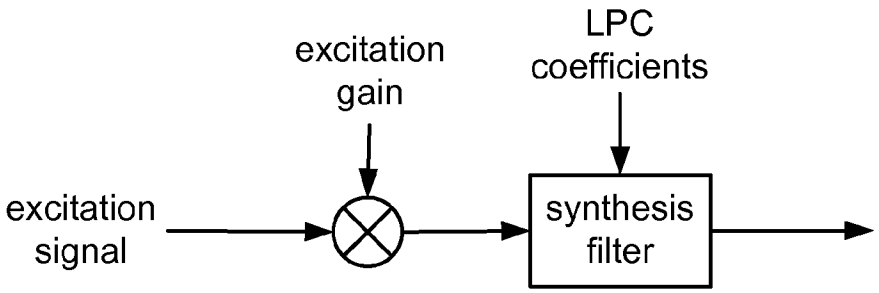
FIG. 1 is a block diagram of a generic speech decoder based on an excited synthesis filter.

Configurations described herein include systems, methods, and apparatus for frame erasure recovery that may be used to provide improved performance for cases in which a significant frame of a sustained voiced segment is erased. Alternatively, a significant frame of a sustained voiced segment may be denoted as a crucial frame. It is expressly contemplated and hereby disclosed that such configurations may be adapted for use in networks that are packet-switched (for example, wired and/or wireless networks arranged to carry voice transmissions according to protocols such as VoIP) and/or circuit-switched. It is also expressly contemplated and hereby disclosed that such configurations may be adapted for use in narrowband coding systems (e.g., systems that encode an audio frequency range of about four or five kilohertz) as well as wideband coding systems (e.g., systems that encode audio frequencies greater than five kilohertz), including whole-band coding systems and split-band coding systems.

Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, and/or selecting from a set of values. Unless expressly limited by its context, the term "obtaining" is used to indicate any of its ordinary meanings, such as calculating, deriving, receiving (e.g., from an external device), and/or retrieving (e.g., from an array of storage elements). Where the term "comprising" is used in the present description and claims, it does not exclude other elements or operations. The term "based on" (as in "A is based on B") is used to indicate any of its ordinary meanings, including the cases (i) "based on at least" (e.g., "A is based on at least B") and, if appropriate in the particular context, (ii) "equal to" (e.g., "A is equal to B").

Unless indicated otherwise, any disclosure of a speech decoder having a particular feature is also expressly intended to disclose a method of speech decoding having an analogous feature (and vice versa), and any disclosure of a speech decoder according to a particular configuration is also expressly intended to disclose a method of speech decoding according to an analogous configuration (and vice versa).

For speech coding purposes, a speech signal is typically digitized (or quantized) to obtain a stream of samples. The digitization process may be performed in accordance with any of various methods known in the art including, for example, pulse code modulation (PCM), companded mu-law PCM, and companded A-law PCM. Narrowband speech encoders typically use a sampling rate of 8 kHz, while wideband speech encoders typically use a higher sampling rate (e.g., 12 or 16 kHz).

The digitized speech signal is processed as a series of frames. This series is usually implemented as a nonoverlapping series, although an operation of processing a frame or a segment of a frame (also called a subframe) may also include segments of one or more neighboring frames in its input. The frames of a speech signal are typically short enough that the spectral envelope of the signal may be expected to remain relatively stationary over the frame. A frame typically corresponds to between five and thirty-five milliseconds of the speech signal (or about forty to 200 samples), with ten, twenty, and thirty milliseconds being common frame sizes. The actual size of the encoded frame may change from frame to frame with the coding bit rate.

A frame length of twenty milliseconds corresponds to 140 samples at a sampling rate of seven kilohertz (kHz), 160 samples at a sampling rate of eight kHz, and 320 samples at a sampling rate of 16 kHz, although any sampling rate deemed suitable for the particular application may be used. Another example of a sampling rate that may be used for speech coding is 12.8 kHz, and further examples include other rates in the range of from 12.8 kHz to 38.4 kHz.

Typically all frames have the same length, and a uniform frame length is assumed in the particular examples described herein. However, it is also expressly contemplated and hereby disclosed that nonuniform frame lengths may be used. For example, implementations of method M100 and M200 may also be used in applications that employ different frame lengths for active and inactive frames and/or for voiced and unvoiced frames.

An encoded frame typically contains values from which a corresponding frame of the speech signal may be reconstructed. For example, an encoded frame may include a description of the distribution of energy within the frame over a frequency spectrum. Such a distribution of energy is also called a "frequency envelope" or "spectral envelope" of the frame. An encoded frame typically includes an ordered sequence of values that describes a spectral envelope of the frame. In some cases, each value of the ordered sequence indicates an amplitude or magnitude of the signal at a corresponding frequency or over a corresponding spectral region. One example of such a description is an ordered sequence of Fourier transform coefficients.

In other cases, the ordered sequence includes values of parameters of a coding model. One typical example of such an ordered sequence is a set of values of coefficients of a linear prediction coding (LPC) analysis. These coefficients encode the resonances of the encoded speech (also called "formants") and may be configured as filter coefficients or as reflection coefficients. The encoding portion of most modern speech coders includes an analysis filter that extracts a set of LPC coefficient values for each frame. The number of coefficient values in the set (which is usually arranged as one or more vectors) is also called the "order" of the LPC analysis. Examples of a typical order of an LPC analysis as performed by a speech encoder of a communications device (such as a cellular telephone) include four, six, eight, ten, 12, 16, 20, 24, 28, and 32.

The description of a spectral envelope typically appears within the encoded frame in quantized form (e.g., as one or more indices into corresponding lookup tables or "codebooks"). Accordingly, it is customary for a decoder to receive a set of LPC coefficient values in a form that is more efficient for quantization, such as a set of values of line spectral pairs (LSPs), line spectral frequencies (LSFs), immittance spectral pairs (ISPs), immittance spectral frequencies (ISFs), cepstral coefficients, or log area ratios. The speech decoder is typically configured to convert such a set into a corresponding set of LPC coefficient values.

FIG. 1 shows a generic example of a speech decoder that includes an excited synthesis filter. To decode the encoded frame, the dequantized LPC coefficient values are used to configure a synthesis filter at the decoder. The encoded frame may also include temporal information, or information that describes a distribution of energy over time within the frame period. For example, the temporal information may describe an excitation signal that is used to excite the synthesis filter to reproduce the speech signal.

An active frame of a speech signal may be classified as one of two or more different types, such as voiced (e.g., representing a vowel sound), unvoiced (e.g., representing a fricative sound), or transitional (e.g., representing the beginning or end of a word). Frames of voiced speech tend to have a periodic structure that is long-term (i.e., that continues for more than one frame period) and is related to pitch, and it is typically more efficient to encode a voiced frame (or a sequence of voiced frames) using a coding mode that encodes a description of this long-term spectral feature. Examples of such coding modes include code-excited linear prediction (CELP), prototype pitch period (PPP), and prototype waveform interpolation (PWI). Unvoiced frames and inactive frames, on the other hand, usually lack any significant long-term spectral feature, and a speech encoder may be configured to encode these frames using a coding mode that does not attempt to describe such a feature. Noise-excited linear prediction (NELP) is one example of such a coding mode.

Figure 2:
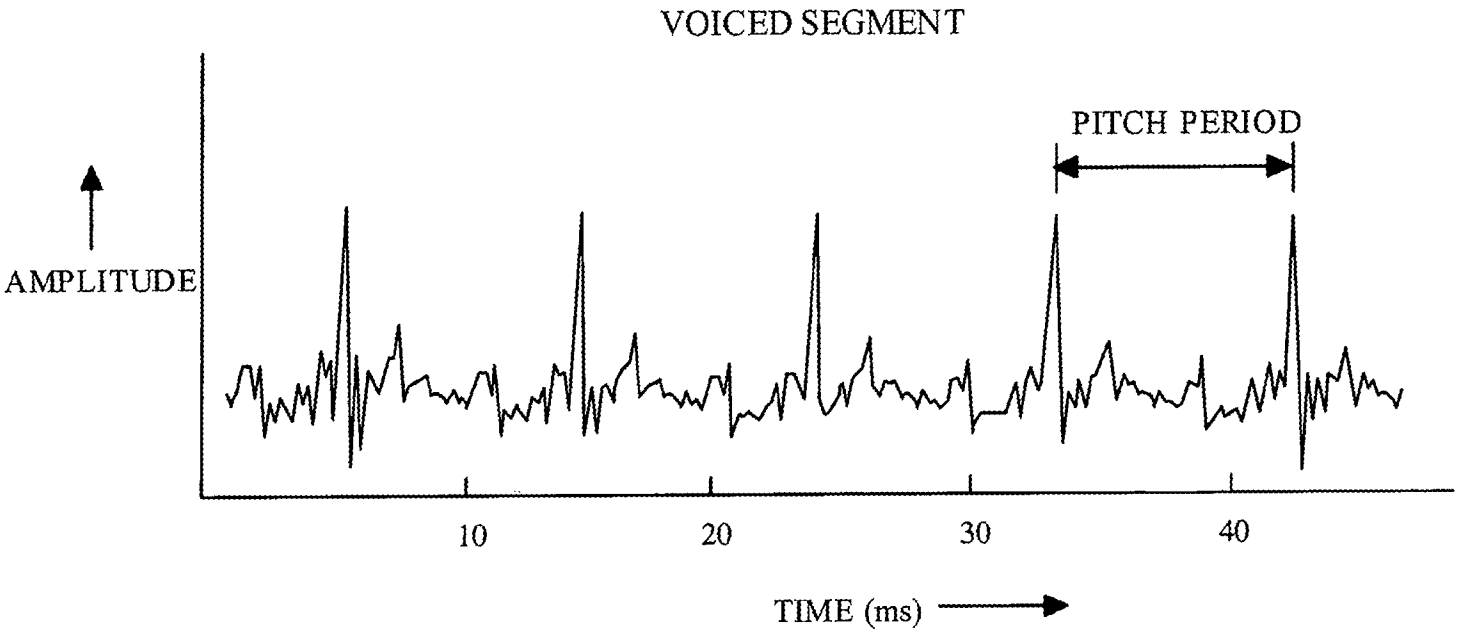
FIG. 2 is a diagram representing the amplitude of a voiced segment of speech over time.

FIG. 2 shows one example of the amplitude of a voiced speech segment (such as a vowel) over time. For a voiced frame, the excitation signal typically resembles a series of pulses that is periodic at the pitch frequency, while for an unvoiced frame the excitation signal is typically similar to white Gaussian noise. A CELP coder may exploit the higher periodicity that is characteristic of voiced speech segments to achieve better coding efficiency.

A CELP coder is an analysis-by-synthesis speech coder that uses one or more codebooks to encode the excitation signal. At the encoder, one or more codebook entries are selected. The decoder receives the codebook indices of these entries, along with corresponding values of gain factors (which may also be indices into one or more gain codebooks). The decoder scales the codebook entries (or signals based thereon) by the gain factors to obtain the excitation signal, which is used to excite the synthesis filter and obtain the decoded speech signal.

Some CELP systems model periodicity using a pitch-predictive filter. Other CELP systems use an adaptive codebook (or ACB, also called "pitch codebook") to model the periodic or pitch-related component of the excitation signal, with a fixed codebook (also called "innovative codebook") typically being used to model the nonperiodic component as, for example, a series of pulse positions. In general, highly voiced segments are the most perceptually relevant. For a highly voiced speech frame that is encoded using an adaptive CELP scheme, most of the excitation signal is modeled by the ACB, which is typically strongly periodic with a dominant frequency component corresponding to the pitch lag.

The ACB contribution to the excitation signal represents a correlation between the residue of the current frame and information from one or more past frames. An ACB is usually implemented as a memory that stores samples of past speech signals, or derivatives thereof such as speech residual or excitation signals. For example, the ACB may contain copies of the previous residue delayed by different amounts. In one example, the ACB includes a set of different pitch periods of the previously synthesized speech excitation waveform.

One parameter of an adaptively coded frame is the pitch lag (also called delay or pitch delay). This parameter is commonly expressed as the number of speech samples that maximizes the autocorrelation function of the frame and may include a fractional component. The pitch frequency of a human voice is generally in the range of from 40 Hz to 500 Hz, which corresponds to about 200 to 16 samples. One example of an adaptive CELP decoder translates the selected ACB entry by the pitch lag. The decoder may also interpolate the translated entry (e.g., using a finite-impulse-response or FIR filter). In some cases, the pitch lag may serve as the ACB index. Another example of an adaptive CELP decoder is configured to smooth (or "time-warp") a segment of the adaptive codebook according to corresponding consecutive but different values of the pitch lag parameter.

Figure 3:
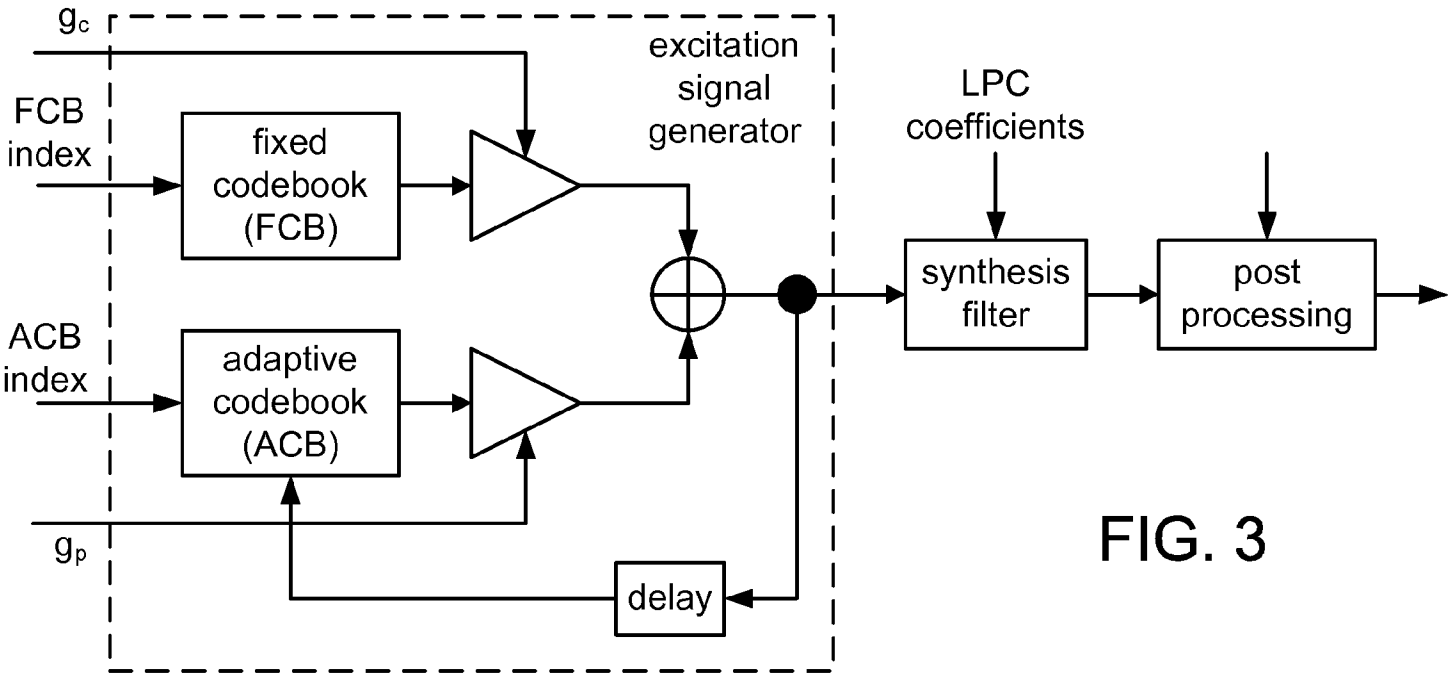
FIG. 3 is a block diagram of a CELP decoder having fixed and adaptive codebooks.

Another parameter of an adaptively coded frame is the ACB gain (or pitch gain), which indicates the strength of the long-term periodicity and is usually evaluated for each subframe. To obtain the ACB contribution to the excitation signal for a particular subframe, the decoder multiplies the interpolated signal (or a corresponding portion thereof) by the corresponding ACB gain value. FIG. 3 shows a block diagram of one example of a CELP decoder having an ACB, where $g_c$ and $g_p$ denote the codebook gain and the pitch gain, respectively. Another common ACB parameter is the delta delay, which indicates the difference in delay between the current and previous frames and may be used to compute the pitch lag for erased or corrupted frames.

A well-known time-domain speech coder is the Code Excited Linear Predictive (CELP) coder described in L. B. Rabiner & R. W. Schafer, Digital Processing of Speech Signals, pp. 396-453 (1978). An exemplary variable rate CELP coder is described in U.S. Pat. No. 5,414,796, which is assigned to the assignee of the present invention and fully incorporated herein by reference. There are many variants of CELP. Representative examples include the following: AMR Speech Codec (Adaptive Multi-Rate, Third Generation Partnership Project (3GPP) Technical Specification (TS) 26.090, ch. 4, 5 and 6, December, 2004); AMR-WB Speech Codec (AMR-Wideband, International Telecommunications Union (ITU)-T Recommendation G.722.2, ch. 5 and 6, July, 2003); and EVRC (Enhanced Variable Rate Codec), Electronic Industries Alliance (EIA)/Telecommunications Industry Association (TIA) Interim Standard IS-127, ch. 4 and ch. 5, January, 1997).

Figure 4:
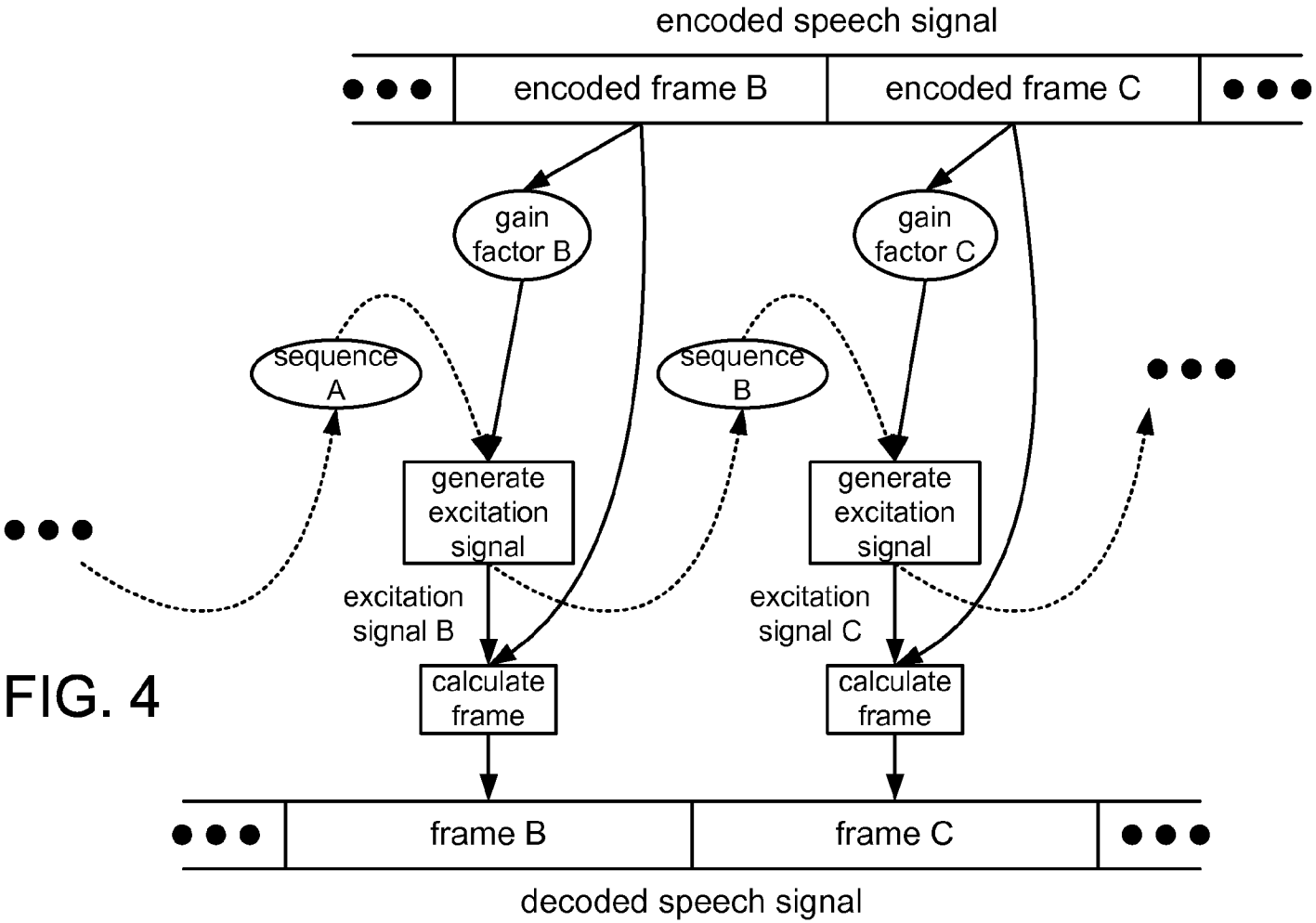
FIG. 4 illustrates data dependencies in a process of decoding a series of frames encoded in a CELP format.

FIG. 4 illustrates data dependencies in a process of decoding a series of CELP frames. Encoded frame B provides an adaptive gain factor B, and the adaptive codebook provides a sequence A based on information from a previous excitation signal A. The decoding process generates an excitation signal B based on adaptive gain factor B and sequence A, which is spectrally shaped according to spectral information from encoded frame B to produce decoded frame B. The decoding process also updates the adaptive codebook based on excitation signal B. The next encoded frame C provides an adaptive gain factor C, and the adaptive codebook provides a sequence B based on excitation signal B. The decoding process generates an excitation signal C based on adaptive gain factor C and sequence B, which is spectrally shaped according to spectral information from encoded frame C to produce decoded frame C. The decoding process also updates the adaptive codebook based on excitation signal C and so on, until a frame encoded in a different coding mode (e.g., NELP) is encountered.

It may be desirable to use variable-rate coding schemes (for example, to balance network demand and capacity). It may also be desirable to use a multimode coding scheme wherein frames are encoded using different modes according to a classification based on, for example, periodicity or voicing. For example, it may be desirable for a speech coder to use different coding modes and/or bit rates for active frames and inactive frames. It may also be desirable for a speech coder to use different combinations of bit rates and coding modes (also called "coding schemes") for different types of active frames. One example of such a speech coder uses a full-rate CELP scheme for frames containing voiced speech and transitional frames, a half-rate NELP scheme for frames containing unvoiced speech, and an eighth-rate NELP scheme for inactive frames. Other examples of such a speech coder support multiple coding rates for one or more coding schemes, such as full-rate and half-rate CELP schemes and/or full-rate and quarter-rate PPP schemes.

Figure 5:
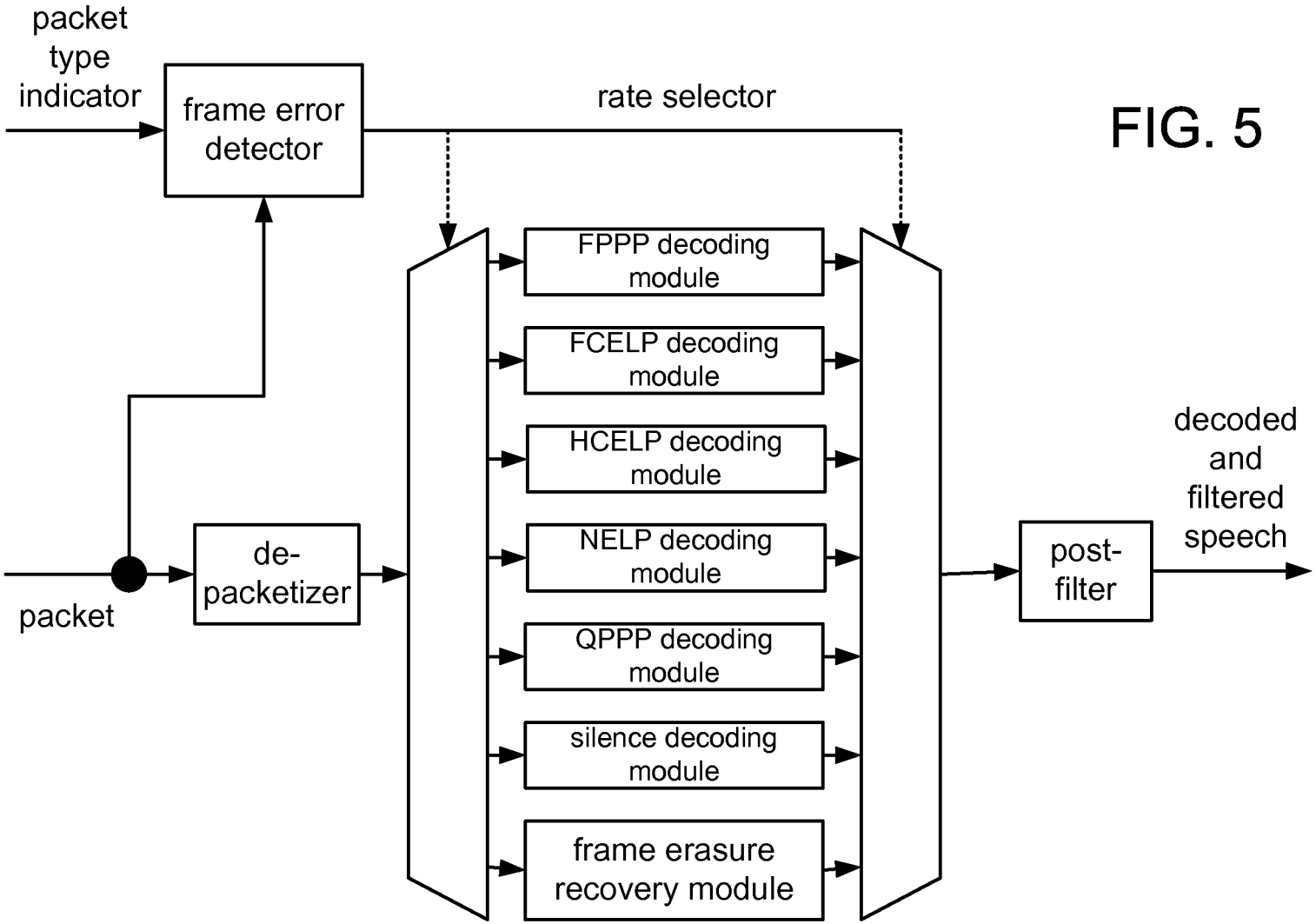
FIG. 5 shows a block diagram of an example of a multimode variable-rate speech decoder.

FIG. 5 shows a block diagram of an example of a multimode variable-rate decoder that receives packets and corresponding packet type indicators (e.g., from a multiplex sublayer). In this example, a frame error detector selects the corresponding rate (or erasure recovery) according to the packet type indicator, and a depacketizer disassembles the packet and selects the corresponding mode. Alternatively, the frame erasure detector may be configured to select the correct coding scheme. The available modes in this example include full- and half-rate CELP, full- and quarter-rate PPP (prototype pitch period, used for strongly voiced frames), NELP (used for unvoiced frames), and silence. The decoder typically includes a postfilter that is configured to reduce quantization noise (e.g., by emphasizing formant frequencies and/or attenuating spectral valleys) and may also include adaptive gain control.

Figure 6:
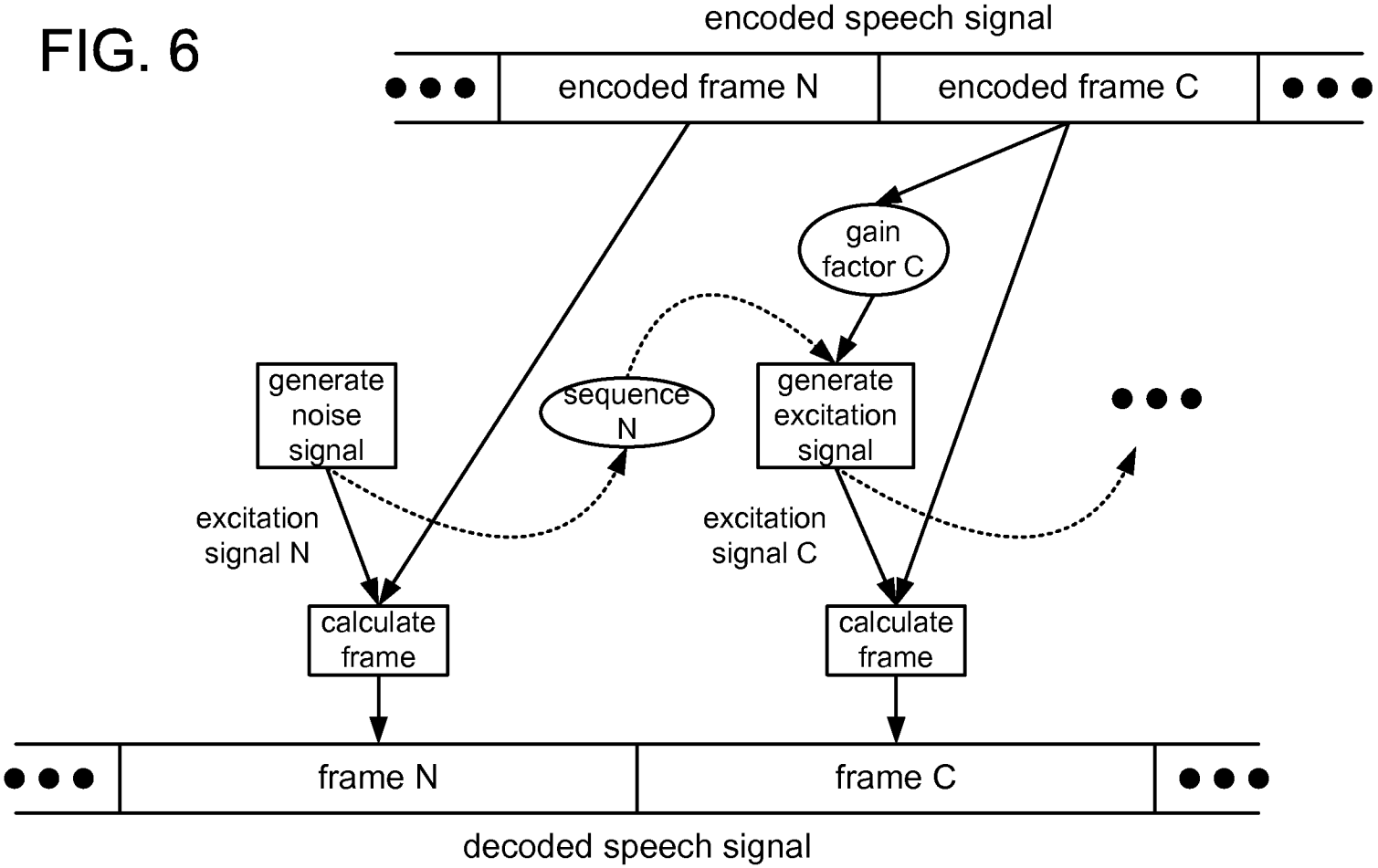
FIG. 6 illustrates data dependencies in a process of decoding the sequence of a NELP frame (e.g., a silence or unvoiced speech frame) followed by a CELP frame.

FIG. 6 illustrates data dependencies in a process of decoding a NELP frame followed by a CELP frame. To decode encoded NELP frame N, the decoding process generates a noise signal as excitation signal N, which is spectrally shaped according to spectral information from encoded frame N to produce decoded frame N. In this example, the decoding process also updates the adaptive codebook based on excitation signal N. Encoded CELP frame C provides an adaptive gain factor C, and the adaptive codebook provides a sequence N based on excitation signal N. The correlation between the excitation signals of NELP frame N and CELP frame C is likely to be very low, such that the correlation between sequence N and the excitation signal of frame C is also likely to be very low. Consequently, adaptive gain factor C is likely to have a value close to zero. The decoding process generates an excitation signal C that is nominally based on adaptive gain factor C and sequence N but is likely to be more heavily based on fixed codebook information from encoded frame C, and excitation signal C is spectrally shaped according to spectral information from encoded frame C to produce decoded frame C. The decoding process also updates the adaptive codebook based on excitation signal C.

In some CELP coders, the LPC coefficients are updated for each frame, while excitation parameters such as pitch lag and/or ACB gain are updated for each subframe. In AMR-WB, for example, CELP excitation parameters such as pitch lag and ACB gain are updated once for each of four subframes. In a CELP mode of EVRC, each of the three subframes (of length 53, 53, and 54 samples, respectively) of a 160-sample frame has corresponding ACB and FCB gain values and a corresponding FCB index. Different modes within a single codec may also process frames differently. In the EVRC codec, for example, a CELP mode processes the excitation signal according to frames having three subframes, while a NELP mode processes the excitation signal according to frames having four subframes. Modes that process the excitation signal according to frames having two subframes also exist.

A variable-rate speech decoder may be configured to determine a bit rate of an encoded frame from one or more parameters such as frame energy. In some applications, the coding system is configured to use only one coding mode for a particular bit rate, such that the bit rate of the encoded frame also indicates the coding mode. In other cases, the encoded frame may include information, such as a set of one or more bits, which identifies the coding mode according to which the frame is encoded. Such a set of bits is also called a "coding index." In some cases, the coding index may explicitly indicate the coding mode. In other cases, the coding index may implicitly indicate the coding mode, e.g. by indicating a value that would be invalid for another coding mode. In this description and the attached claims, the term "format" or "frame format" is used to indicate the one or more aspects of an encoded frame from which the coding mode may be determined, which aspects may include the bit rate and/or the coding index as described above.

Figure 7:
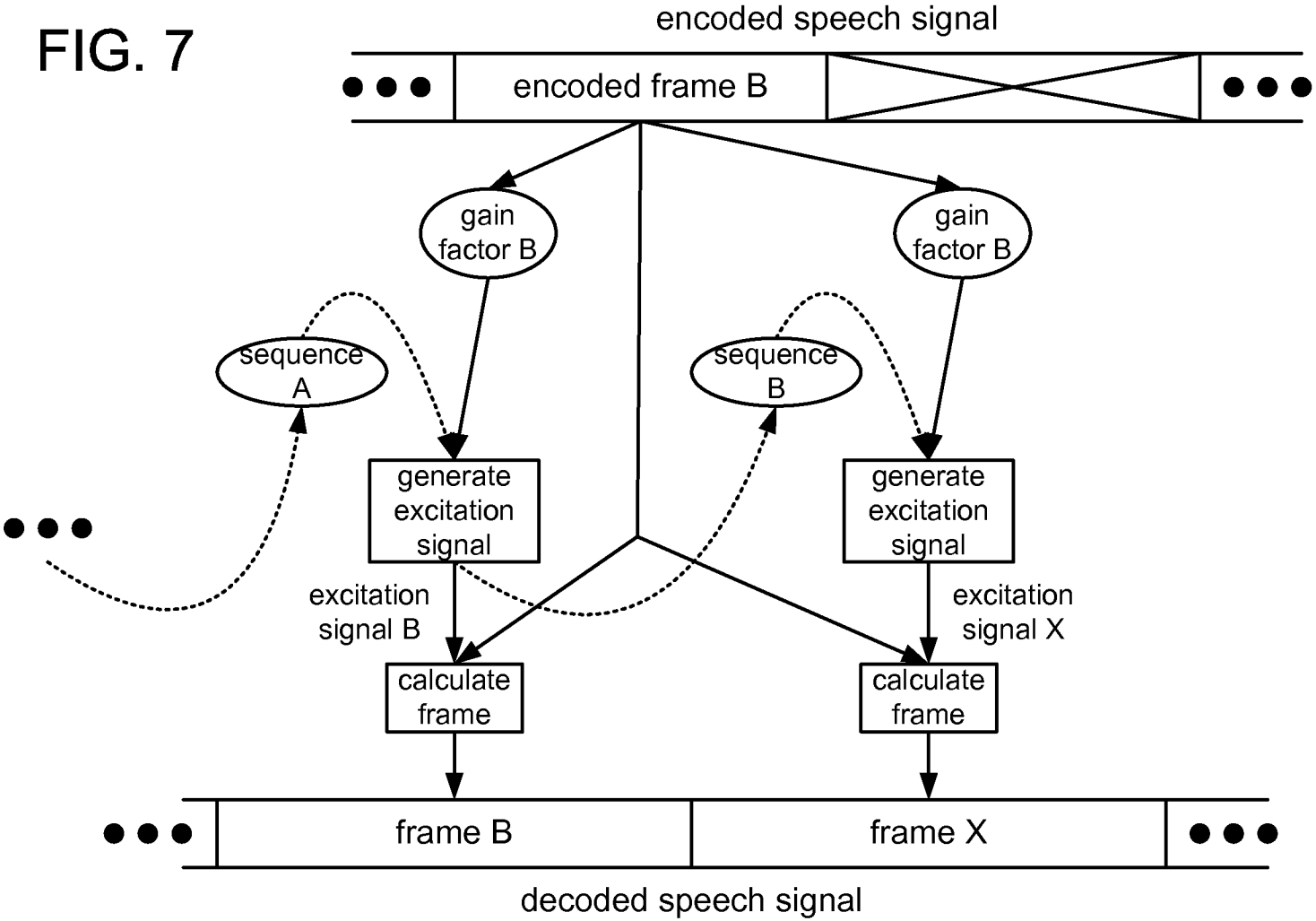
FIG. 7 illustrates data dependencies in a process of handling a frame erasure that follows a frame encoded in a CELP format.

FIG. 7 illustrates data dependencies in a process of handling a frame erasure that follows a CELP frame. As in FIG. 4, encoded frame B provides an adaptive gain factor B, and the adaptive codebook provides a sequence A based on information from a previous excitation signal A. The decoding process generates an excitation signal B based on adaptive gain factor B and sequence A, which is spectrally shaped according to spectral information from encoded frame B to produce decoded frame B. The decoding process also updates the adaptive codebook based on excitation signal B. In response to an indication that the next encoded frame is erased, the decoding process continues to operate in the previous coding mode (i.e., CELP), such that the adaptive codebook provides a sequence B based on excitation signal B. In this case, the decoding process generates an excitation signal X based on adaptive gain factor B and sequence B, which is spectrally shaped according to spectral information from encoded frame B to produce decoded frame X.

Figure 8:
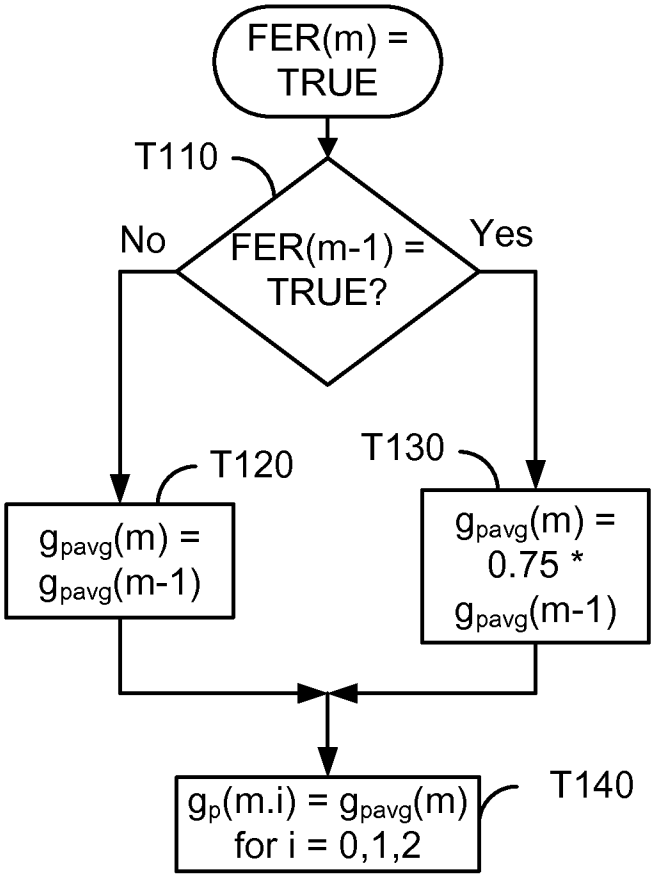
FIG. 8 shows a flowchart for a method of frame erasure compliant with EVRC Service Option 3.

FIG. 8 shows a flowchart for a method of frame erasure recovery that is compliant with the 3GPP2 standard C.S0014-A v1.0 (EVRC Service Option 3), ch. 5, April 2004. United States Patent Appl. Publ. No. 2002/0123887 (Unno) describes a similar process according to the ITU-T recommendation G.729. Such a method may be performed, for example, by a frame error recovery module as shown in FIG. 5. The method initiates with detection that the current frame is unavailable (e.g., that the value of the frame erasure flag for the current frame [FER(m)] is TRUE). Task T110 determines whether the previous frame was also unavailable. In this implementation, task T110 determines whether the value of the frame erasure flag for the previous frame [FER(m−1)] is also TRUE.

If the previous frame was not erased, task T120 sets the value of the average adaptive codebook gain for the current frame [$g_{pavg}$(m)] to the value of the average adaptive codebook gain for the previous frame [$g_{pavg}$(m−1)]. Otherwise (i.e., if the previous frame was also erased), then task T130 sets the value of the average ACB gain for the current frame [$g_{pavg}$(m)] to an attenuated version of the average ACB gain for the previous frame [$g_{pavg}$(m−1)]. In this example, task T130 sets the average ACB gain to 0.75 times the value of $g_{pavg}$(m−1). Task T140 then sets the values of the ACB gain for the subframes of the current frame [$g_p$(m.i) for i=0, 1, 2] to the value of $g_{pavg}$(m). Typically the FCB gain factors are set to zero for the erased frame. Section 5.2.3.5 of the 3GPP2 standard C.S0014-C v1.0 describes a variant of this method for EVRC Service Option 68 in which the values of the ACB gain for the subframes of the current frame [$g_p$(m.i) for i=0, 1, 2] are set to zero if the previous frame was erased or was processed as a silence or NELP frame.

The frame that follows a frame erasure may be decoded without error only in a memoryless system or coding mode. For modes that exploit a correlation to one or more past frames, a frame erasure may cause errors to propagate into subsequent frames. For example, state variables of an adaptive decoder may need some time to recover from a frame erasure. For a CELP coder, the adaptive codebook introduces a strong interframe dependency and is typically the principal cause of such error propagation. Consequently, it is typical to use an ACB gain that is no higher than the previous average, as in task T120, or even to attenuate the ACB gain, as in task T130. In certain cases, however, such practice may adversely affect the reproduction of subsequent frames.

Figure 9:
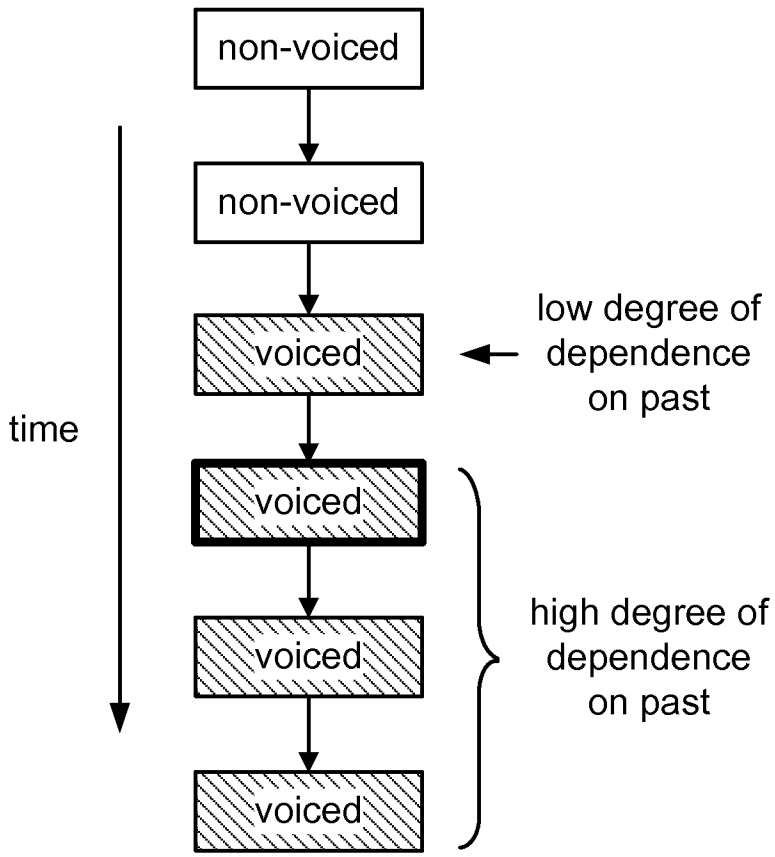
FIG. 9 shows a time sequence of frames that includes the start of a sustained voiced segment.

FIG. 9 illustrates the example of a sequence of frames that includes a non-voiced segment followed by a sustained voiced segment. Such a sustained voiced segment may occur in a word such as "crazy" or "feel." As indicated in this figure, the first frame of the sustained voiced segment has a low dependence on the past. Specifically, if the frame is encoded using an adaptive codebook, the adaptive codebook gain values for the frame will be low. For the rest of the frames in the sustained voiced segment, the ACB gain values will typically be high as a consequence of the strong correlation between adjacent frames.

In such a situation, a problem may arise if the second frame of the sustained voiced segment is erased. Because this frame has a high dependence on the previous frame, its adaptive codebook gain values should be high, reinforcing the periodic component. Because the frame erasure recovery will typically reconstruct the erased frame from the preceding frame, however, the recovered frame will have low adaptive codebook gain values, such that the contribution from the previous voiced frame will be inappropriately low. This error may be propagated through the next several frames. For such reasons, the second frame of a sustained voiced segment is also called a significant frame. Alternatively, the second frame of a sustained voiced segment may also be called a crucial frame.

FIGS. 10*a*, 10*b*, 10*c*, and 10*d* show flowcharts for methods M110, M120, M130, and M140 according to respective configurations of the disclosure. The first task in these methods (tasks T11, T12, and T13) detects one or more particular sequences of modes in the two frames preceding a frame erasure or (task T14) detects the erasure of a significant frame of a sustained voiced segment. In tasks T11, T12, and T13, the particular sequence or sequences is typically determined with reference to the modes according to which those frames are encoded.

Figure 10B:
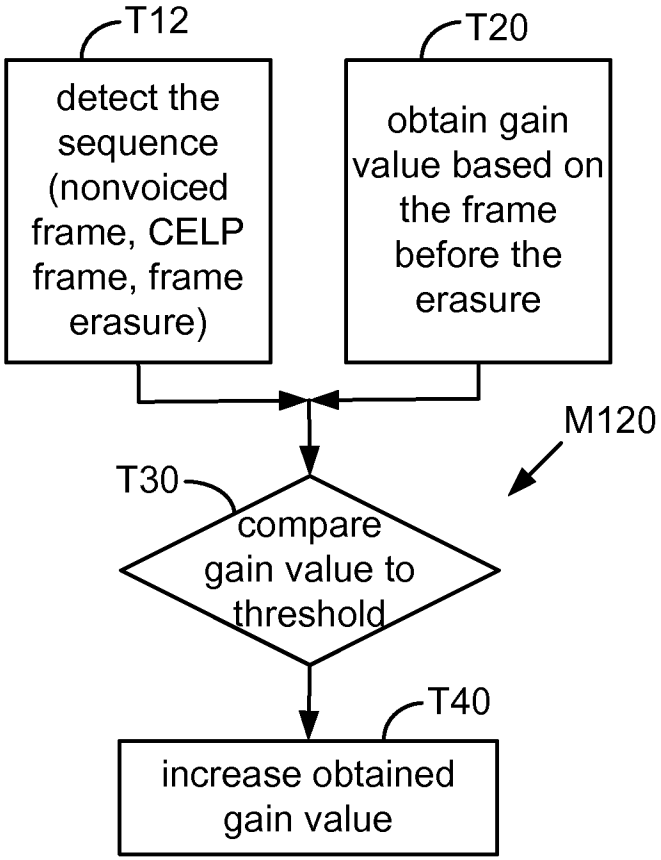
FIGS. 10*a*, 10*b*, 10*c*, and 10*d* show flowcharts for methods M110, M120, M130, and M140 respectively, according to configurations of the disclosure.
Figure 10A:
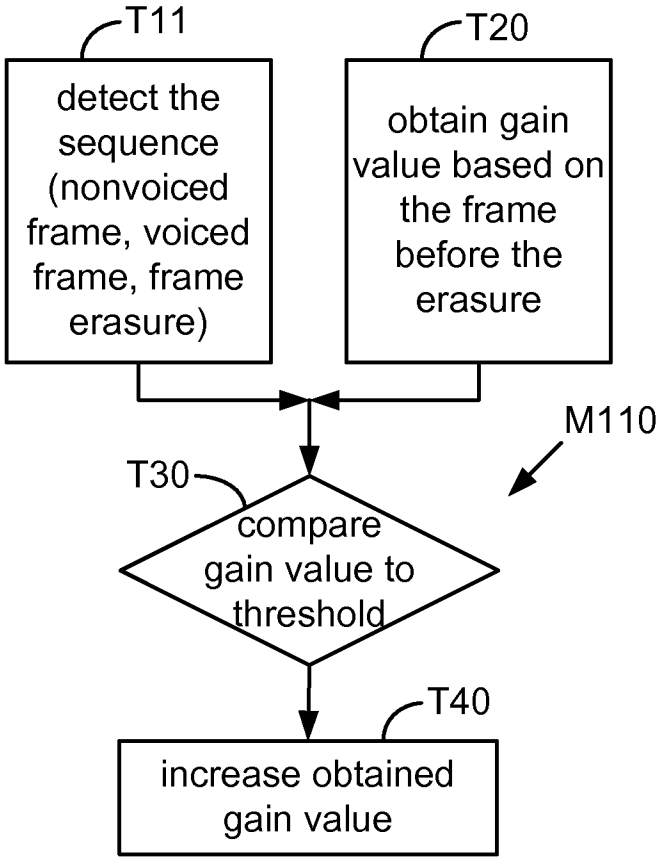
Figure 10D:
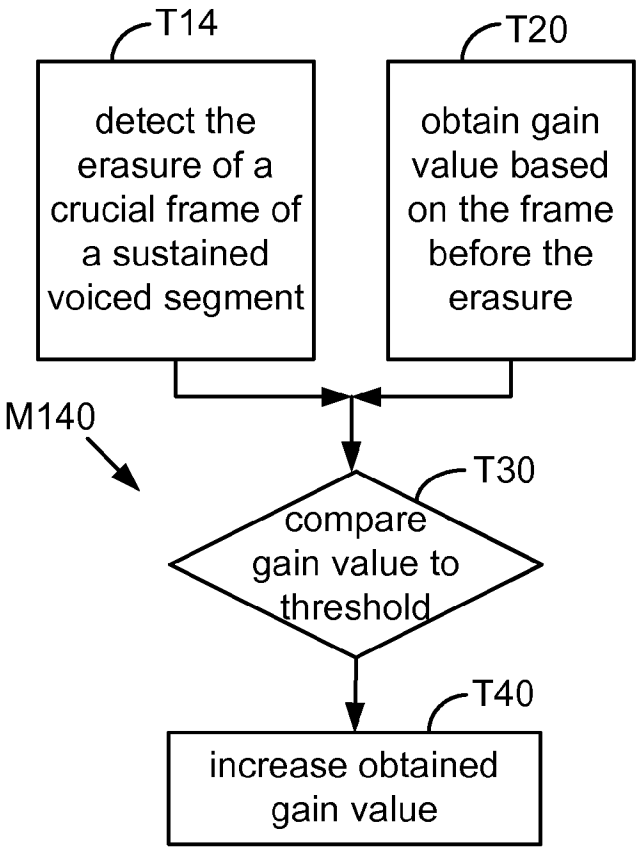
Figure 10C:
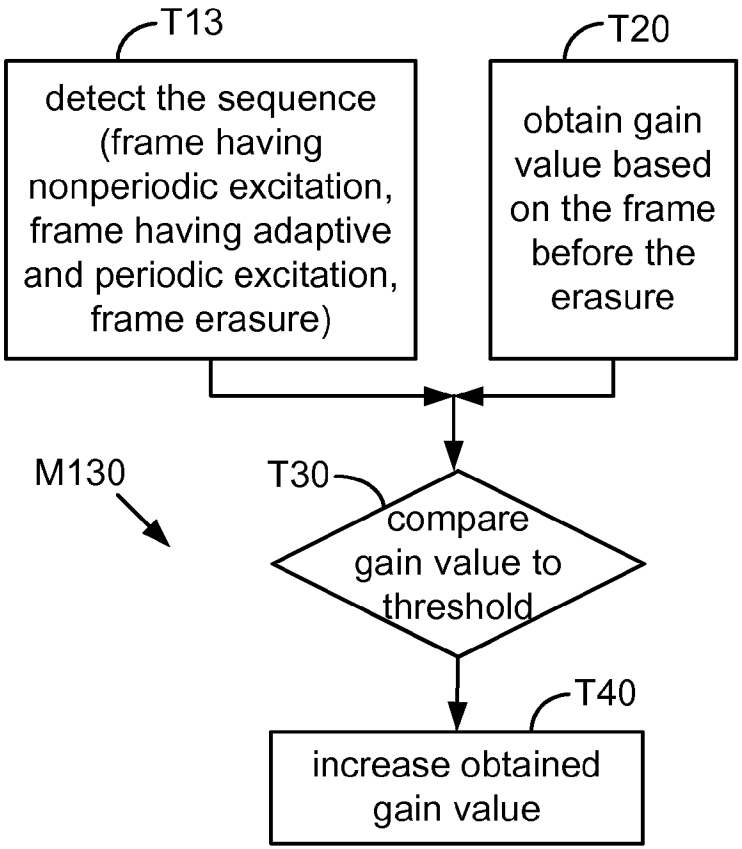

In method M110, task T11 detects the sequence (nonvoiced frame, voiced frame, frame erasure). The category of "nonvoiced frames" may include silence frames (i.e., background noise) as well as unvoiced frames such as fricatives. For example, the category "unvoiced frames" may be implemented to include frames that are encoded in either a NELP mode or silence mode (which is typically also a NELP mode). As shown in FIG. 10*b*, the category of "voiced frames" may be restricted in task T12 to frames encoded using a CELP mode (e.g., in a decoder that also has one or more PPP modes). This category may also be further restricted to frames encoded using a CELP mode that has an adaptive codebook (e.g., in a decoder that also supports a CELP mode having only a fixed codebook).

Task T13 of method M130 characterizes the target sequence in terms of the excitation signal used in the frames, with the first frame having a nonperiodic excitation (e.g., a random excitation as used in NELP or silence coding) and the second frame having an adaptive and periodic excitation (e.g., as used in a CELP mode having an adaptive codebook). In another example, task T13 is implemented such that the detected sequence also includes first frames having no excitation signal. Task T14 of method M140, which detects the erasure of a significant frame of a sustained voiced segment, may be implemented to detect a frame erasure immediately following the sequence (NELP or silence frame, CELP frame).

Task T20 obtains a gain value based at least in part on the frame before the erasure. For example, the obtained gain value may be a gain value that is predicted for the erased frame (e.g., by a frame erasure recovery module). In a particular example, the gain value is an excitation gain value (such as an ACB gain value) predicted for the erased frame by a frame erasure recovery module. Tasks T110 to T140 of FIG. 8 show one example in which several ACB values are predicted based on the frame that precedes an erasure.

If the indicated sequence (or one of the indicated sequences) is detected, then task T30 compares the obtained gain value to a threshold value. If the obtained gain value is less than (alternatively, not greater than) the threshold value, task T40 increases the obtained gain value. For example, task T40 may be configured to add a positive value to the obtained gain value, or to multiply the obtained gain value by a factor greater than unity. Alternatively, task T40 may be configured to replace the obtained gain value with one or more higher values.

Figure 11:
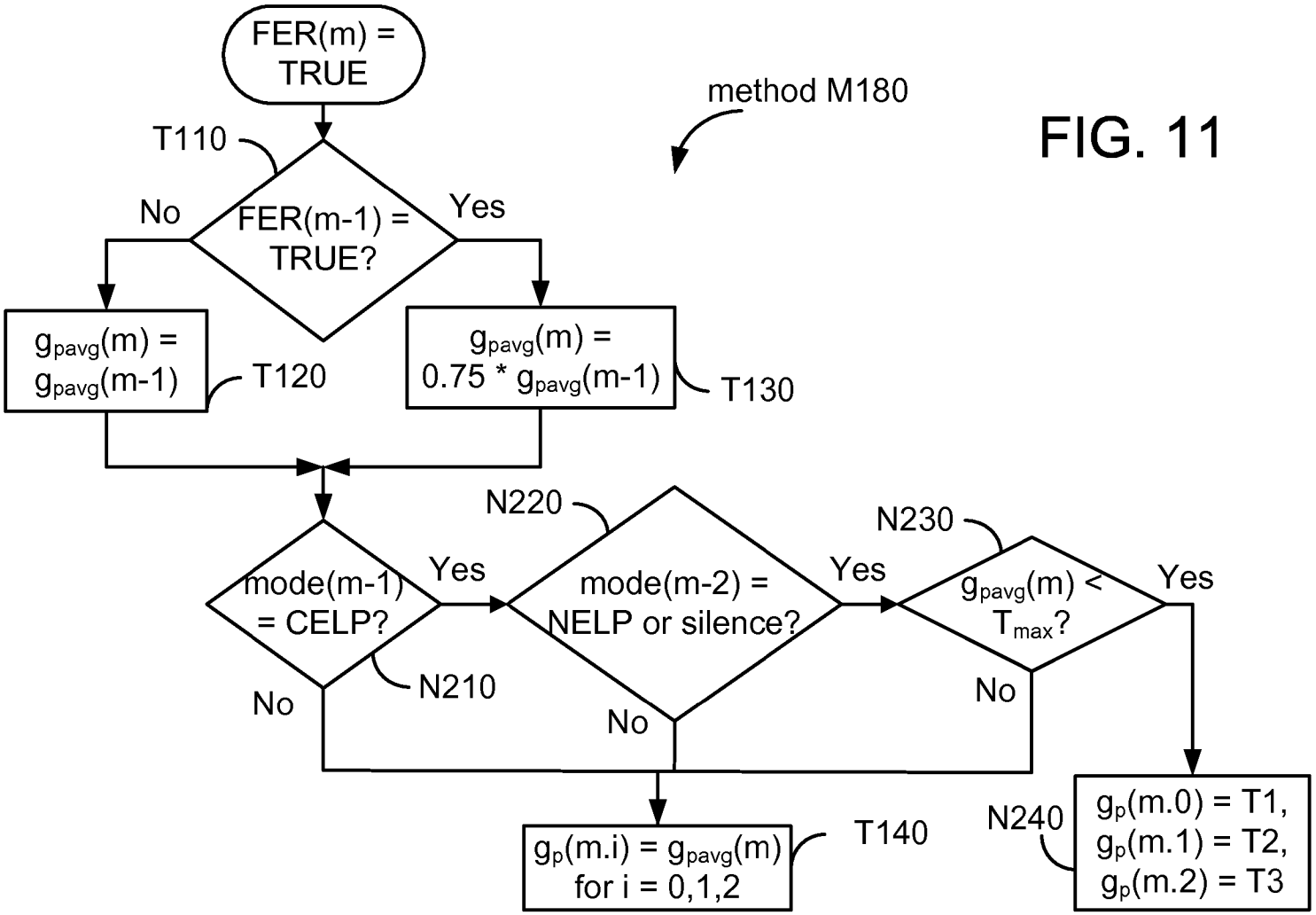
FIG. 11 shows a flowchart for an implementation M180 of method M120.

FIG. 11 shows a flowchart of a configuration M180 of method M120. Tasks T110, T120, T130, and T140 are as described above. After the value of $g_{pavg}(m)$ has been set (task T120 or T130), tasks N210, N220, and N230 test certain conditions relating to the current frame and the recent history. Task N210 determines whether the previous frame was encoded as a CELP frame. Task N220 determines whether the frame before the previous one was encoded as a nonvoiced frame (e.g., as NELP or silence). Task N230 determines whether the value of $g_{pavg}(m)$ is less than a threshold value T. If the result of any of tasks N210, N220, and N230 is negative, then task T140 executes as described above. Otherwise, task N240 assigns a new gain profile to the current frame.

In the particular example shown in FIG. 11, task N240 assigns values T1, T2, and T3, respectively, to the values of $g_p(m.i)$ for i=0, 1, 2. These values may be arranged such that T1≥T2≥T3, resulting in a gain profile that is either level or decreasing, with T1 being close to (or equal to) $T_{max}$.

Other implementations of task N240 may be configured to multiply one or more values of $g_p(m.i)$ by respective gain factors (at least one being greater than unity) or by a common gain factor, or to add a positive offset to one or more values of $g_p(m.i)$. In such cases, it may be desirable to impose an upper limit (e.g., $T_{max}$) on each value of $g_p(m.i)$. Tasks N210 to N240 may be implemented as hardware, firmware, and/or software routines within a frame erasure recovery module.

In some techniques, the erased frame is extrapolated from information received during one or more previous frames, and possibly one or more following frames. In some configurations, speech parameters in both previous and future frames are used for reconstruction of an erased frame. In this case, task T20 may be configured to calculate the obtained gain value based on both the frame before the erasure and the frame after the erasure. Additionally or alternatively, an implementation of task T40 (e.g., task N240) may use information from a future frame to select a gain profile (e.g., via interpolation of gain values). For example, such an implementation of task T40 may select a level or increasing gain profile in place of a decreasing one, or an increasing gain profile in place of a level one. A configuration of this kind may use a jitter buffer to indicate whether a future frame is available for such use.

Figure 12:
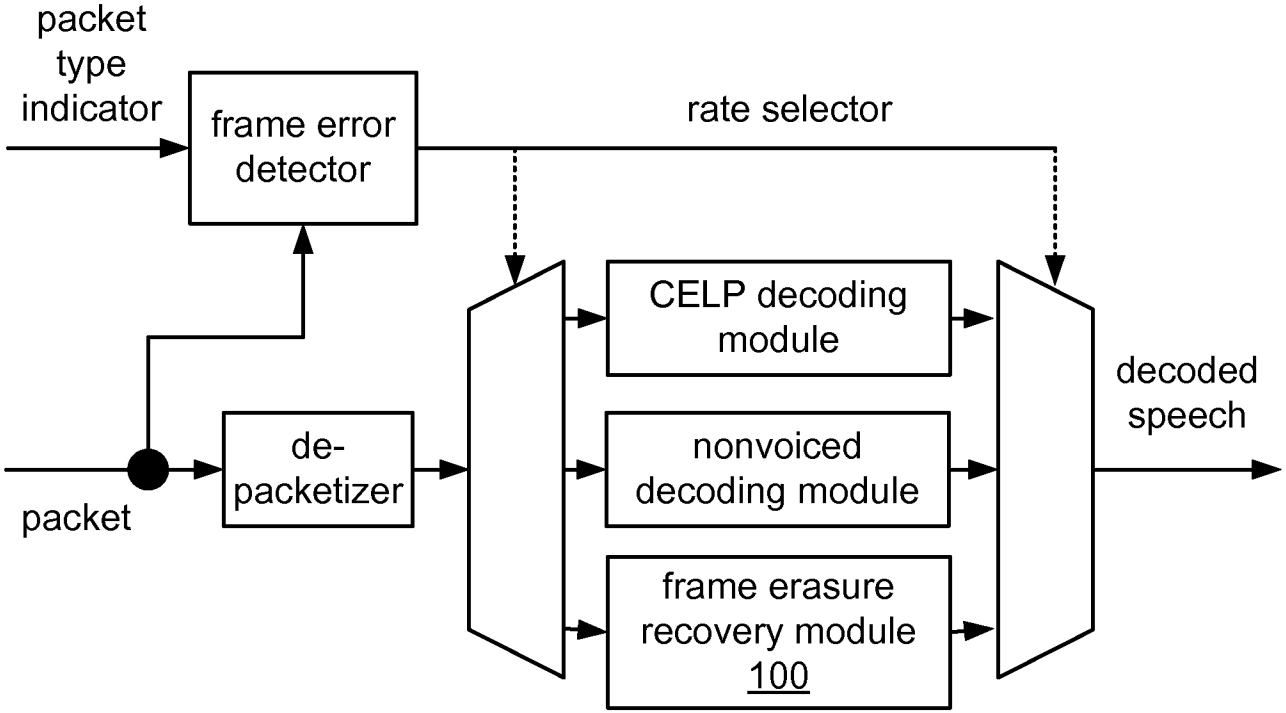
FIG. 12 shows a block diagram of an example of a speech decoder according to a configuration.

FIG. 12 shows a block diagram of a speech decoder including a frame erasure recovery module 100 according to a configuration. Such a module 100 may be configured to perform a method M110, M120, M130, or M180 as described herein.

Figure 13A:
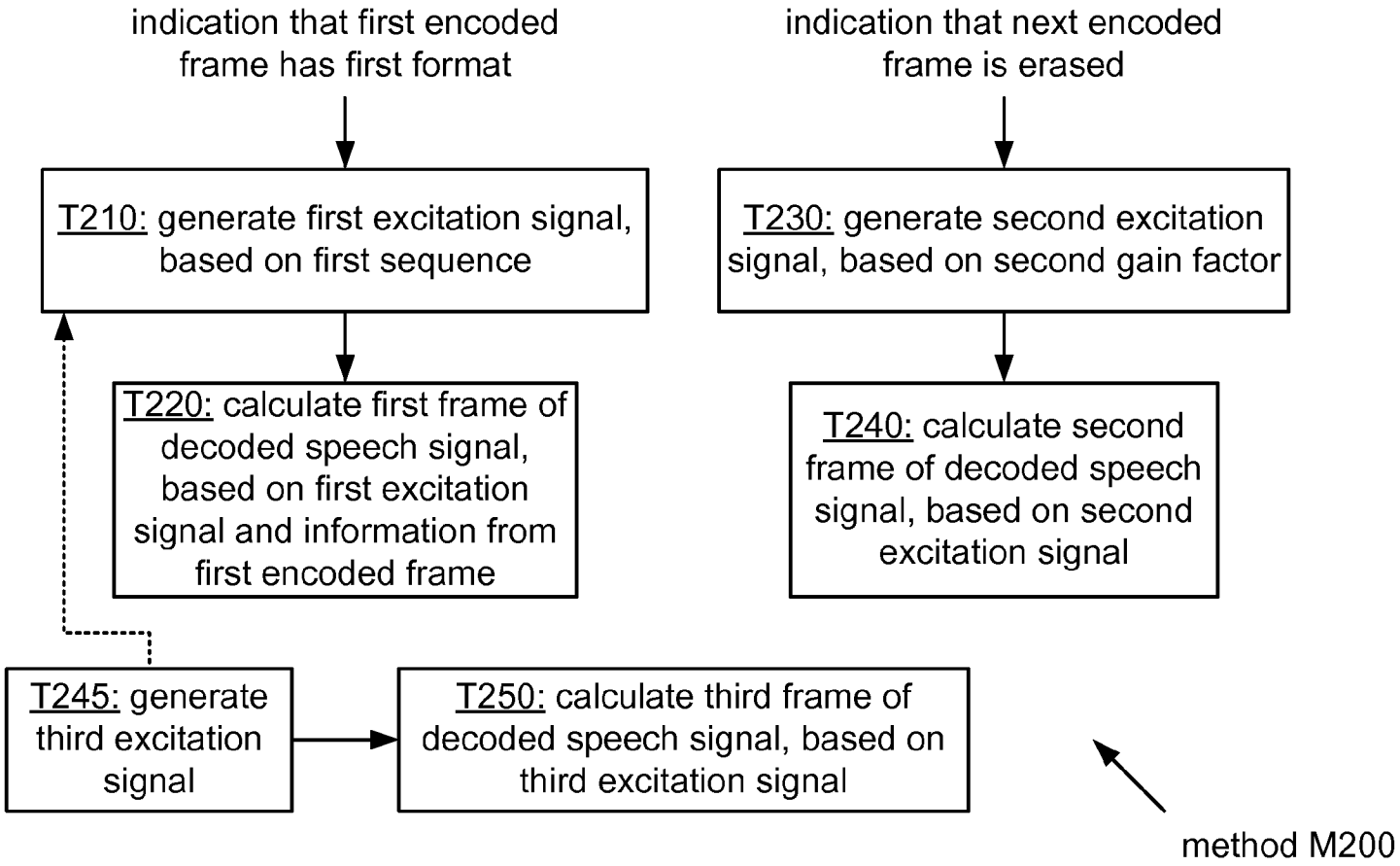
FIG. 13A shows a flowchart of a method M200 of obtaining frames of a decoded speech signal according to a general configuration.
Figure 14:
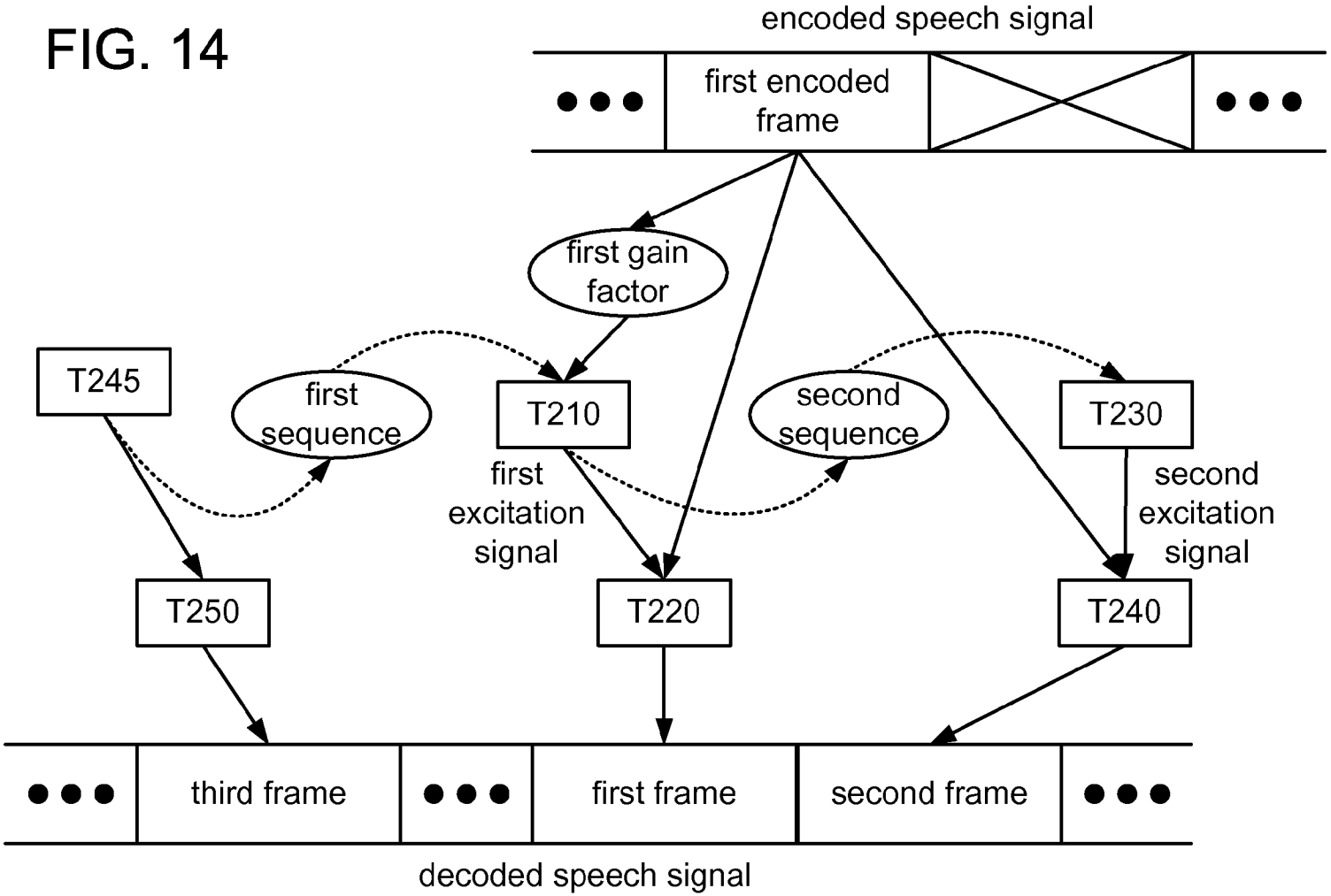
FIG. 14 illustrates data dependencies in an application of an implementation of method M200.

FIG. 13A shows a flowchart of a method M200 of obtaining frames of a decoded speech signal according to a general configuration that includes tasks T210, T220, T230, T240, T245, and T250. Task T210 generates a first excitation signal. Based on the first excitation signal, task T220 calculates a first frame of the decoded speech signal. Task T230 generates a second excitation signal. Based on the second excitation signal, task T240 calculates a second frame which immediately follows the first frame of the decoded speech signal. Task T245 generates the third excitation signal. Depending on the particular application, task T245 may be configured to generate the third excitation signal based on a generated noise signal and/or on information from an adaptive codebook (e.g., based on information from one or more previous excitation signals). Based on the third excitation signal, task T250 calculates a third frame which immediately precedes the first frame of the decoded speech signal. FIG. 14 illustrates some of the data dependencies in a typical application of method M200.

Task T210 executes in response to an indication that a first encoded frame of an encoded speech signal has a first format. The first format indicates that the frame is to be decoded using an excitation signal that is based on a memory of past excitation information (e.g., using a CELP coding mode). For a coding system that uses only one coding mode at the bit rate of the first encoded frame, a determination of the bit rate may be sufficient to determine the coding mode, such that an indication of the bit rate may serve to indicate the frame format as well.

For a coding system that uses more than one coding mode at the bit rate of the first encoded frame, the encoded frame may include a coding index, such as a set of one or more bits that identifies the coding mode. In this case, the format indication may be based on a determination of the coding index. In some cases, the coding index may explicitly indicate the coding mode. In other cases, the coding index may implicitly indicate the coding mode, e.g. by indicating a value that would be invalid for another coding mode.

In response to the format indication, task T210 generates the first excitation signal based on a first sequence of values. The first sequence of values is based on information from the third excitation signal, such as a segment of the third excitation signal. This relation between the first sequence and the third excitation signal is indicated by the dotted line in FIG. 13A. In a typical example, the first sequence is based on the last subframe of the third excitation signal. Task T210 may include retrieving the first sequence from an adaptive codebook.

Figure 13B:
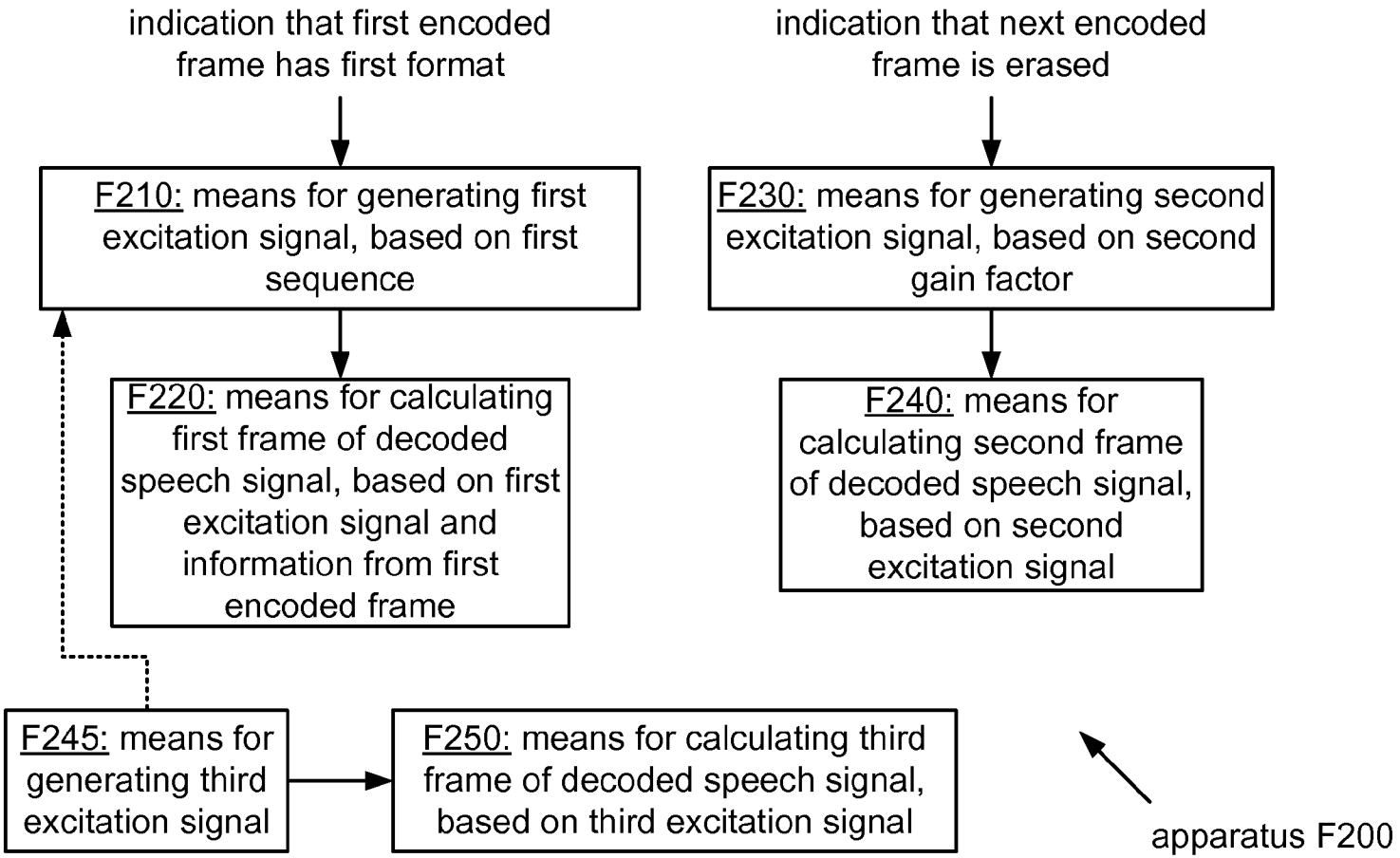
FIG. 13B shows a block diagram of an apparatus F200 for obtaining frames of a decoded speech signal according to a general configuration.

FIG. 13B shows a block diagram of an apparatus F200 for obtaining frames of a decoded speech signal according to a general configuration. Apparatus F200 includes means for performing the various tasks of method M200 of FIG. 13A. Means F210 generates a first excitation signal. Based on the first excitation signal, means F220 calculates a first frame of the decoded speech signal. Means F230 generates a second excitation signal. Based on the second excitation signal, means F240 calculates a second frame which immediately follows the first frame of the decoded speech signal. Means F245 generates the third excitation signal. Depending on the particular application, means F245 may be configured to generate the third excitation signal based on a generated noise signal and/or on information from an adaptive codebook (e.g., based on information from one or more previous excitation signals). Based on the third excitation signal, means F250 calculates a third frame which immediately precedes the first frame of the decoded speech signal.

FIG. 14 shows an example in which task T210 generates the first excitation signal based on a first gain factor and the first sequence. In such case, task T210 may be configured to generate the first excitation signal based on a product of the first gain factor and the first sequence. The first gain factor may be based on information from the first encoded frame, such as an adaptive gain codebook index. Task T210 may be configured to generate the first excitation signal based on other information from the first encoded frame, such as information that specifies a fixed codebook contribution to the first excitation signal (e.g., one or more codebook indices and corresponding gain factor values or codebook indices).

Based on the first excitation signal and information from the first encoded frame, task T220 calculates a first frame of the decoded speech signal. Typically the information from the first encoded frame includes a set of values of spectral parameters (for example, one or more LSF or LPC coefficient vectors), such that task T220 is configured to shape the spectrum of the first excitation signal according to the spectral parameter values. Task T220 may also include performing one or more other processing operations (e.g., filtering, smoothing, interpolation) on the first excitation signal, the information from the first encoded frame, and/or the calculated first frame.

Task T230 executes in response to an indication of erasure of the encoded frame that immediately follows the first encoded frame in the encoded speech signal. The indication of erasure may be based on one or more of the following conditions: (1) the frame contains too many bit errors to be recovered; (2) the bit rate indicated for the frame is invalid or unsupported; (3) all bits of the frame are zero; (4) the bit rate indicated for the frame is eighth-rate, and all bits of the frame are one; (5) the frame is blank and the last valid bit rate was not eighth-rate.

Task T230 also executes according to a relation between a threshold value and a value based on the first gain factor (also called "the baseline gain factor value"). For example, task T230 may be configured to execute if the baseline gain factor value is less than (alternatively, not greater than) the threshold value. The baseline gain factor value may be simply the value of the first gain factor, especially for an application in which the first encoded frame includes only one adaptive codebook gain factor. For an application in which the first encoded frame includes several adaptive codebook gain factors (e.g., a different factor for each subframe), the baseline gain factor value may be based on one or more of the other adaptive codebook gain factors as well. In such case, for example, the baseline gain factor value may be an average of the adaptive codebook gain factors of the first encoded frame, as in the value $g_{pavg}(m)$ discussed with reference to FIG. 11.

Task T230 may also execute in response to an indication that the first encoded frame has the first format and that the encoded frame preceding the first encoded frame ("the preceding frame") has a second format different than the first format. The second format indicates that the frame is to be decoded using an excitation signal that is based on a noise signal (e.g., using a NELP coding mode). For a coding system that uses only one coding mode at the bit rate of the preceding frame, a determination of the bit rate may be sufficient to determine the coding mode, such that an indication of the bit rate may serve to indicate the frame format as well. Alternatively, the preceding frame may include a coding index that indicates the coding mode, such that the format indication may be based on a determination of the coding index.

Task T230 generates a second excitation signal based on a second gain factor that is greater than the first gain factor. The second gain factor may also be greater than the baseline gain factor value. For example, the second gain factor may be equal to or even greater than the threshold value. For a case in which task T230 is configured to generate the second excitation signal as a series of subframe excitation signals, a different value of the second gain factor may be used for each subframe excitation signal, with at least one of the values being greater than the baseline gain factor value. In such case, it may be desirable for the different values of the second gain factor to be arranged to rise or to fall over the frame period.

Task T230 is typically configured to generate the second excitation signal based on a product of the second gain factor and a second sequence of values. As shown in FIG. 14, the second sequence is based on information from the first excitation signal, such as a segment of the first excitation signal. In a typical example, the second sequence is based on the last subframe of the first excitation signal. Accordingly, task T210 may be configured to update an adaptive codebook based on the information from the first excitation signal. For an application of method M200 to a coding system that supports a relaxation CELP (RCELP) coding mode, such an implementation of task T210 may be configured to time-warp the segment according to a corresponding value of a pitch lag parameter. An example of such a warping operation is described in Section 5.2.2 (with reference to Section 4.11.5) of the 3GPP2 document C.S0014-C v1.0 cited above. Further implementations of task T230 may include one or more of the methods M110, M120, M130, M140, and M180 as described above.

Based on the second excitation signal, task T240 calculates a second frame that immediately follows the first frame of the decoded speech signal. As shown in FIG. 14, task T240 may also be configured to calculate the second frame based on information from the first encoded frame, such as a set of spectral parameter values as described above. For example, task T240 may be configured to shape the spectrum of the second excitation signal according to the set of spectral parameter values.

Alternatively, task T240 may be configured to shape the spectrum of the second excitation signal according to a second set of spectral parameter values that is based on the set of spectral parameter values. For example, task T240 may be configured to calculate the second set of spectral parameter values as an average of the set of spectral parameter values from the first encoded frame and an initial set of spectral parameter values. An example of such a calculation as a weighted average is described in Section 5.2.1 of the 3GPP2 document C.S0014-C v1.0 cited above. Task T240 may also include performing one or more other processing operations (e.g., filtering, smoothing, interpolation) on one or more of the second excitation signal, the information from the first encoded frame, and the calculated second frame.

Based on a third excitation signal, task T250 calculates a third frame that precedes the first frame in the decoded speech signal. Task T250 may also include updating the adaptive codebook by storing the first sequence, where the first sequence is based on at least a segment of the third excitation signal. For an application of method M200 to a coding system that supports a relaxation CELP (RCELP) coding mode, task T250 may be configured to time-warp the segment according to a corresponding value of a pitch lag parameter. An example of such a warping operation is described in Section 5.2.2 (with reference to Section 4.11.5) of the 3GPP2 document C.S0014-C v1.0 cited above.

At least some of the parameters of an encoded frame may be arranged to describe an aspect of the corresponding decoded frame as a series of subframes. For example, it is common for an encoded frame formatted according to a CELP coding mode to include a set of spectral parameter values for the frame and a separate set of temporal parameters (e.g., codebook indices and gain factor values) for each of the subframes. The corresponding decoder may be configured to calculate the decoded frame incrementally by subframe. In such case, task T210 may be configured to generate a first excitation signal as a series of subframe excitation signals, such that each of the subframe excitation signals may be based on different gain factors and/or sequences. Task T210 may also be configured to update the adaptive codebook serially with information from each of the subframe excitation signals. Likewise, task T220 may be configured to calculate each subframe of the first decoded frame based on a different subframe of the first excitation signal. Task T220 may also be configured to interpolate or otherwise smooth the set of spectral parameters over the subframes, between frames.

Figure 15A:
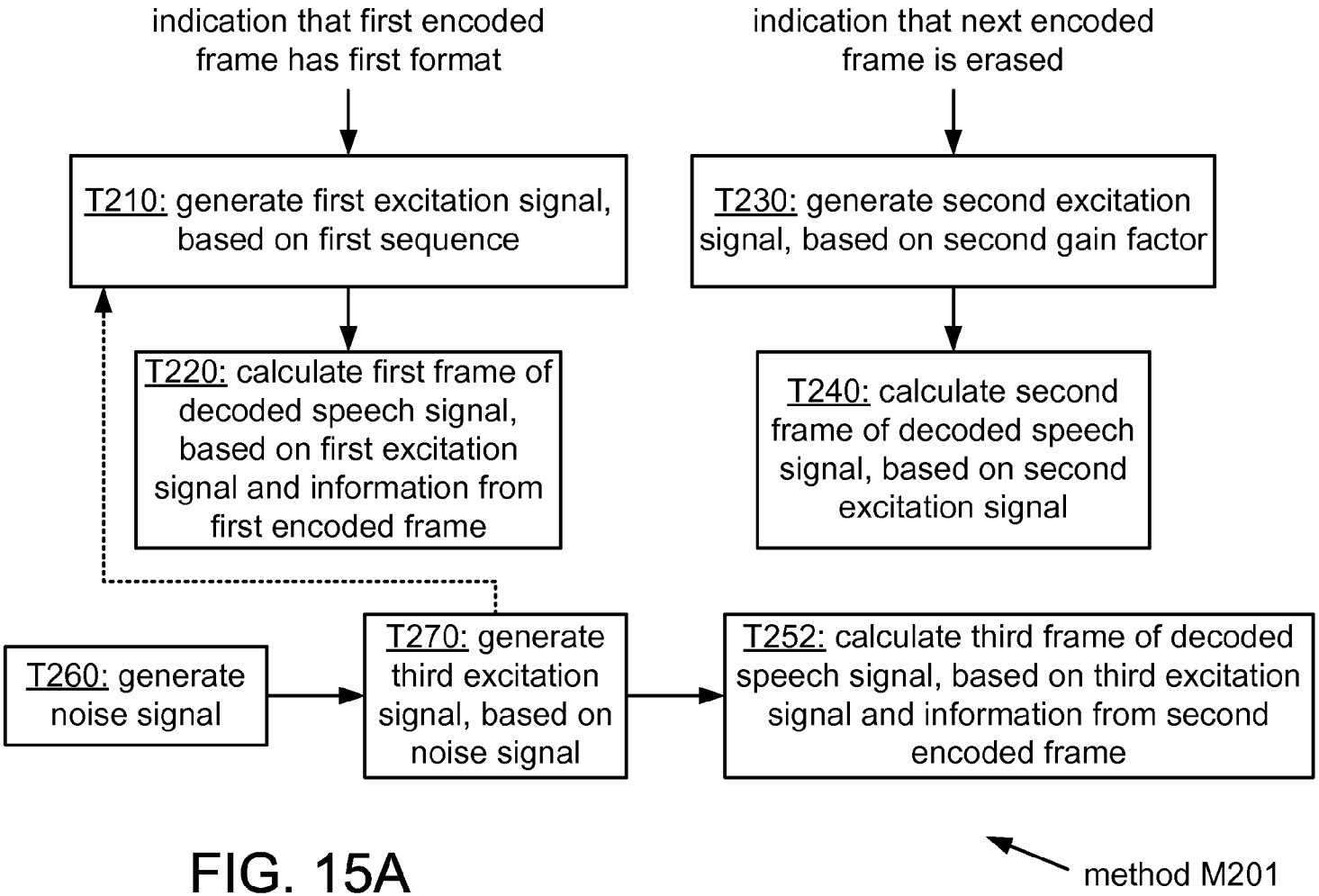
FIG. 15A shows a flowchart of an implementation method M201 of method M200.

FIG. 15A shows that a decoder may be configured to use information from an excitation signal that is based on a noise signal (e.g., an excitation signal generated in response to an indication of a NELP format) to update the adaptive codebook. In particular, FIG. 15A shows a flowchart of such an implementation M201 of method M200 (from FIG. 13A and discussed above), which includes tasks T260 and T270. Task T260 generates a noise signal (e.g., a pseudorandom signal approximating white Gaussian noise), and task T270 generates the third excitation signal based on the generated noise signal. Again, the relation between the first sequence and the third excitation signal is indicated by the dotted line in FIG. 15A. It may be desirable for task T260 to generate the noise signal using a seed value that is based on other information from the corresponding encoded frame (e.g., spectral information), as such a technique may be used to support generation of the same noise signal that was used at the encoder. Method M201 also includes an implementation T252 of task T250 (from FIG. 13A and discussed above) which calculates the third frame based on the third excitation signal. Task T252 is also configured to calculate the third frame based on information from an encoded frame that immediately precedes the first encoded frame ("the preceding frame") and has the second format. In such cases, task T230 may be based on an indication that (A) the preceding frame has the second format and (B) the first encoded frame has the first format.

Figure 15B:
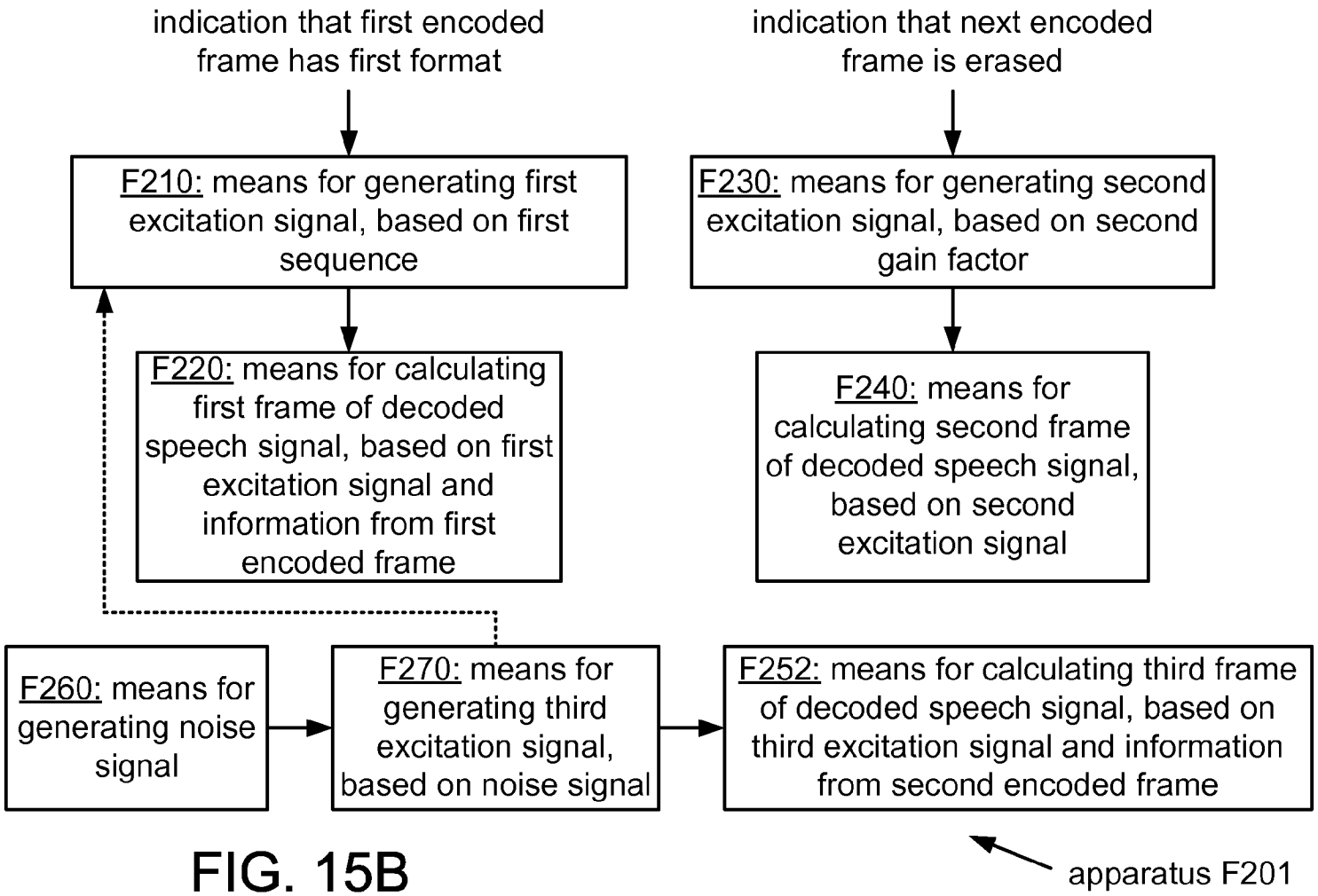
FIG. 15B shows a block diagram of an apparatus F201 corresponding to the method M201 of FIG. 15A.

FIG. 15B shows a block diagram of an apparatus F201 corresponding to the method M201 discussed above with respect to FIG. 15A. Apparatus F201 includes means for performing the various tasks of method M201. The various elements may be implemented according to any structures capable of performing such tasks, including any of the structures for performing such tasks that are disclosed herein (e.g., as one or more sets of instructions, one or more arrays of logic elements, etc.). FIG. 15B shows that a decoder may be configured to use information from an excitation signal that is based on a noise signal (e.g., an excitation signal generated in response to an indication of a NELP format) to update the adaptive codebook. Apparatus F201 of FIG. 15B is similar to apparatus F200 of FIG. 13B with the addition of means F260, F270, and F252. Means F260 generates a noise signal (e.g., a pseudorandom signal approximating white Gaussian noise), and means F270 generates the third excitation signal based on the generated noise signal. Again, the relation between the first sequence and the third excitation signal is indicated by the illustrated dotted line. It may be desirable for means F260 to generate the noise signal using a seed value that is based on other information from the corresponding encoded frame (e.g., spectral information), as such a technique may be used to support generation of the same noise signal that was used at the encoder. Apparatus F201 also includes means F252 which corresponds to means F250 (from FIG. 13A and discussed above). Means F252 calculates the third frame based on the third excitation signal. Means F252 is also configured to calculate the third frame based on information from an encoded frame that immediately precedes the first encoded frame ("the preceding frame") and has the second format. In such cases, means F230 may be based on an indication that (A) the preceding frame has the second format and (B) the first encoded frame has the first format.

Figure 16:
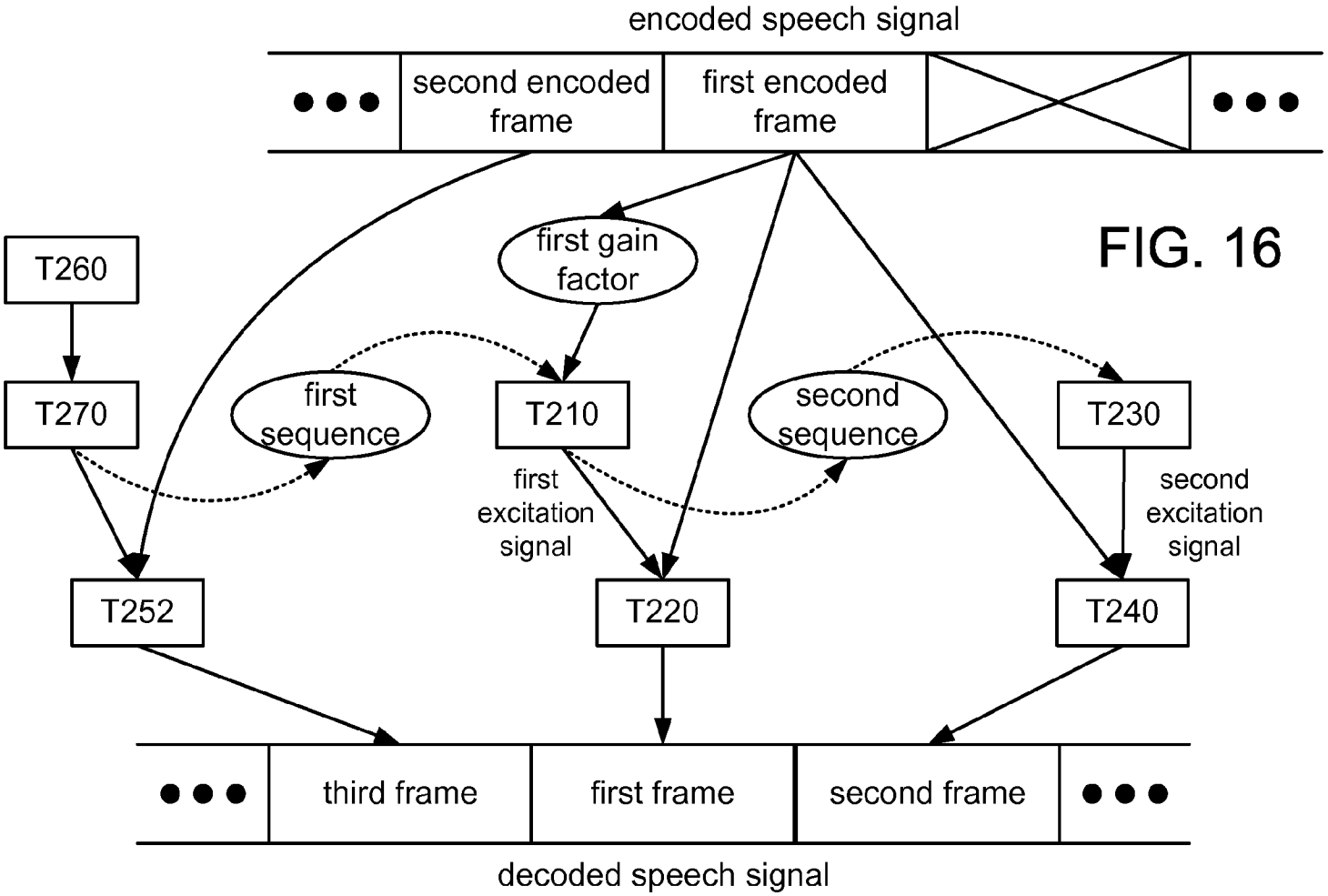
FIG. 16 illustrates some data dependencies in a typical application of method M201.

FIG. 16 illustrates some data dependencies in a typical application of method M201. In this application, the encoded frame that immediately precedes the first encoded frame (indicated in this figure as the "second encoded frame") has the second format (e.g., a NELP format). As shown in FIG. 16, task T252 is configured to calculate the third frame based on information from the second encoded frame. For example, task T252 may be configured to shape the spectrum of the third excitation signal according to a set of spectral parameter values that are based on information from the second encoded frame. Task T252 may also include performing one or more other processing operations (e.g., filtering, smoothing, interpolation) on one or more of the third excitation signal, the information from the second encoded frame, and the calculated third frame. Task T252 may also be configured to update the adaptive codebook based on information from the third excitation signal (e.g., a segment of the third excitation signal).

A speech signal typically includes periods during which the speaker is silent. It may be desirable for an encoder to transmit encoded frames for fewer than all of the inactive frames during such a period. Such operation is also called discontinuous transmission (DTX). In one example, a speech encoder performs DTX by transmitting one encoded inactive frame (also called a "silence descriptor," "silence description," or SID) for each string of 32 consecutive inactive frames. In other examples, a speech encoder performs DTX by transmitting one SID for each string of a different number of consecutive inactive frames (e.g., 8 or 16) and/or by transmitting a SID upon some other event such as a change in frame energy or spectral tilt. The corresponding decoder uses information in the SID (typically, spectral parameter values and a gain profile) to synthesize inactive frames for subsequent frame periods for which no encoded frame was received.

Figure 17:
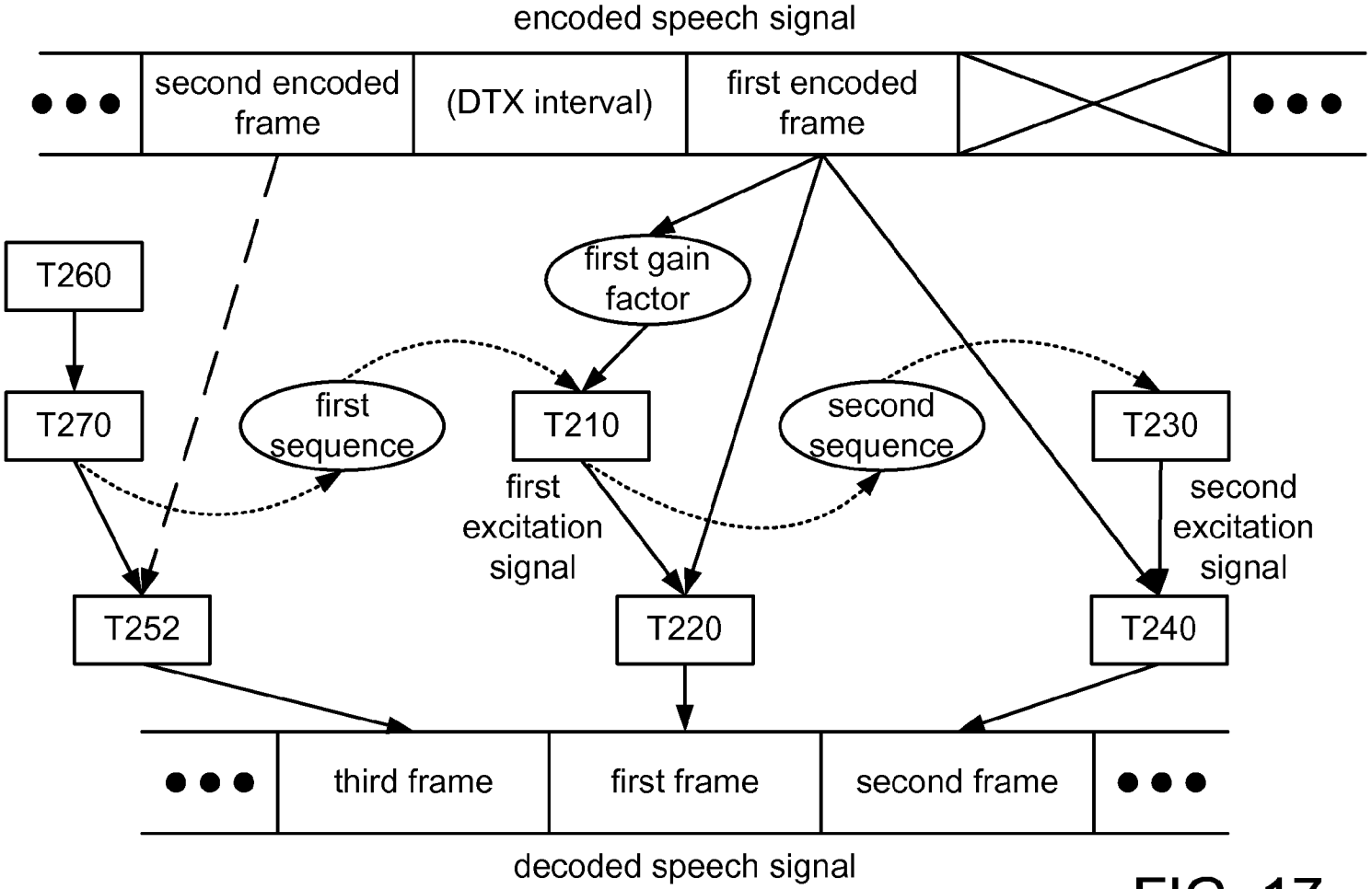
FIG. 17 illustrates data dependencies in an application of an implementation of method M201.

It may be desirable to use method M200 in a coding system that also supports DTX. FIG. 17 illustrates some data dependencies for such an application of method M201 in which the second encoded frame is a SID frame and the frames between this frame and the first encoded frame are blanked (indicated here as the "DTX interval"). The line connecting the second encoded frame to task T252 is dashed to indicate that the information from the second encoded frame (e.g., spectral parameter values) is used to calculate more than one frame of the decoded speech signal.

As noted above, task T230 may execute in response to an indication that the encoded frame preceding the first encoded frame has a second format. For an application as shown in FIG. 17, this indication of a second format may be an indication that the frame immediately preceding the first encoded frame is blanked for DTX, or an indication that a NELP coding mode is used to calculate the corresponding frame of the decoded speech signal. Alternatively, this indication of a second format may be an indication of the format of the second encoded frame (i.e., an indication of the format of the last SID frame prior to the first encoded frame).

FIG. 17 shows a particular example in which the third frame immediately precedes the first frame in the decoded speech signal and corresponds to the last frame period within the DTX interval. In other examples, the third frame corresponds to another frame period within the DTX interval, such that one or more frames separate the third frame from the first frame in the decoded speech signal. FIG. 17 also shows an example in which the adaptive codebook is not updated during the DTX interval. In other examples, one or more excitation signals generated during the DTX interval are used to update the adaptive codebook.

Memory of a noise-based excitation signal may not be useful for generating excitation signals for subsequent frames. Consequently, it may be desirable for a decoder not to use information from noise-based excitation signals to update the adaptive codebook. For example, such a decoder may be configured to update the adaptive codebook only when decoding a CELP frame; or only when decoding a CELP, PPP, or PWI frame; and not when decoding a NELP frame.

Figure 18:
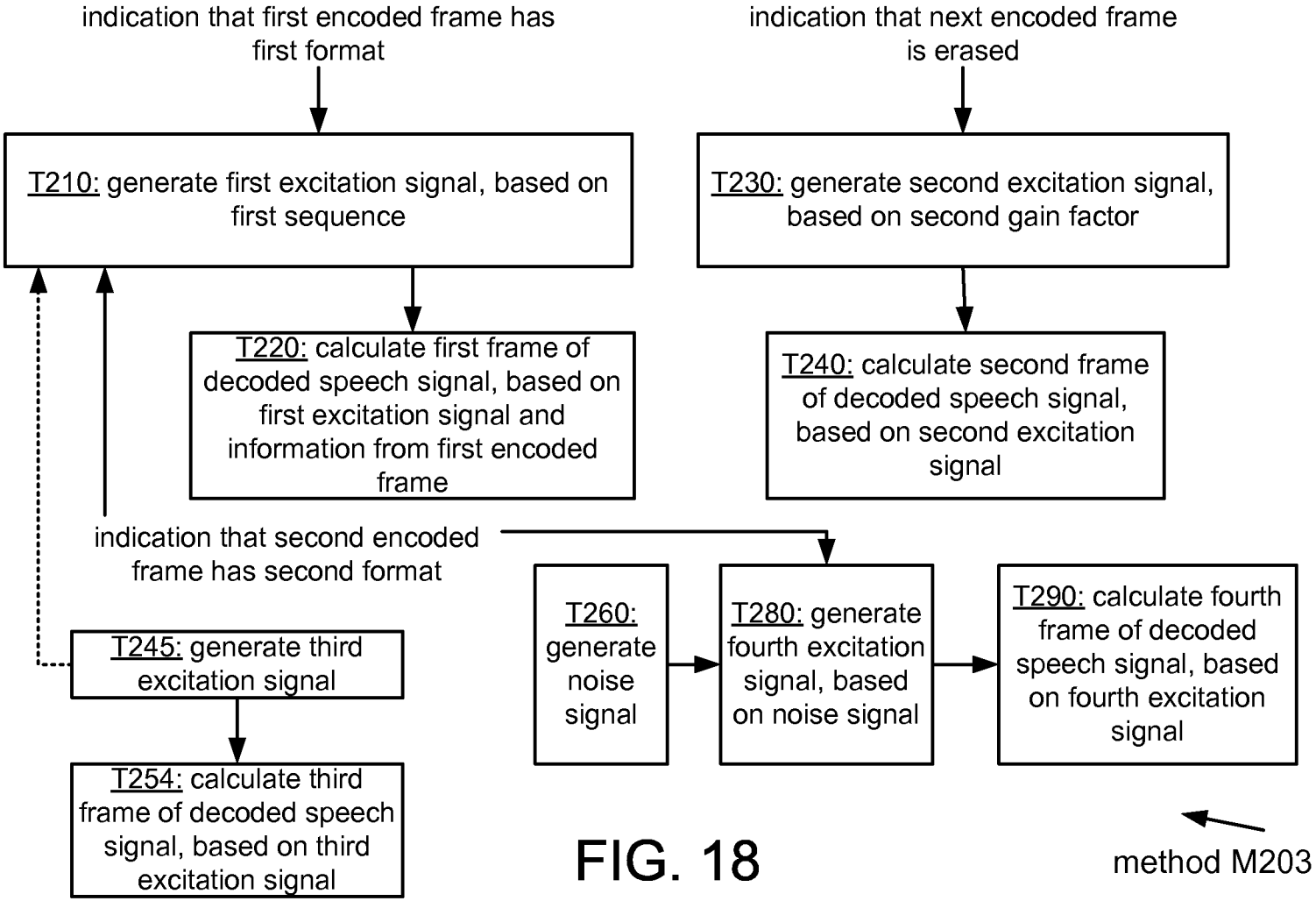
FIG. 18 shows a flowchart of an implementation method M203 of method M200.

FIG. 18 shows a flowchart of such an implementation method M203 of method M200 (of FIG. 13A) that includes tasks T260, T280, and T290. Task T280 generates a fourth excitation signal based on the noise signal generated by task T260. In this particular example, tasks T210 and T280 are configured to execute according to an indication that the second encoded frame has the second format, as indicated by the solid line. Based on the fourth excitation signal, task T290 calculates a fourth frame of the decoded speech signal that immediately precedes the third frame. Method M203 also includes an implementation T254 of task T250 (of FIG. 13A), which calculates the third frame of the decoded speech signal based on the third excitation signal from task T245.

Figure 19:
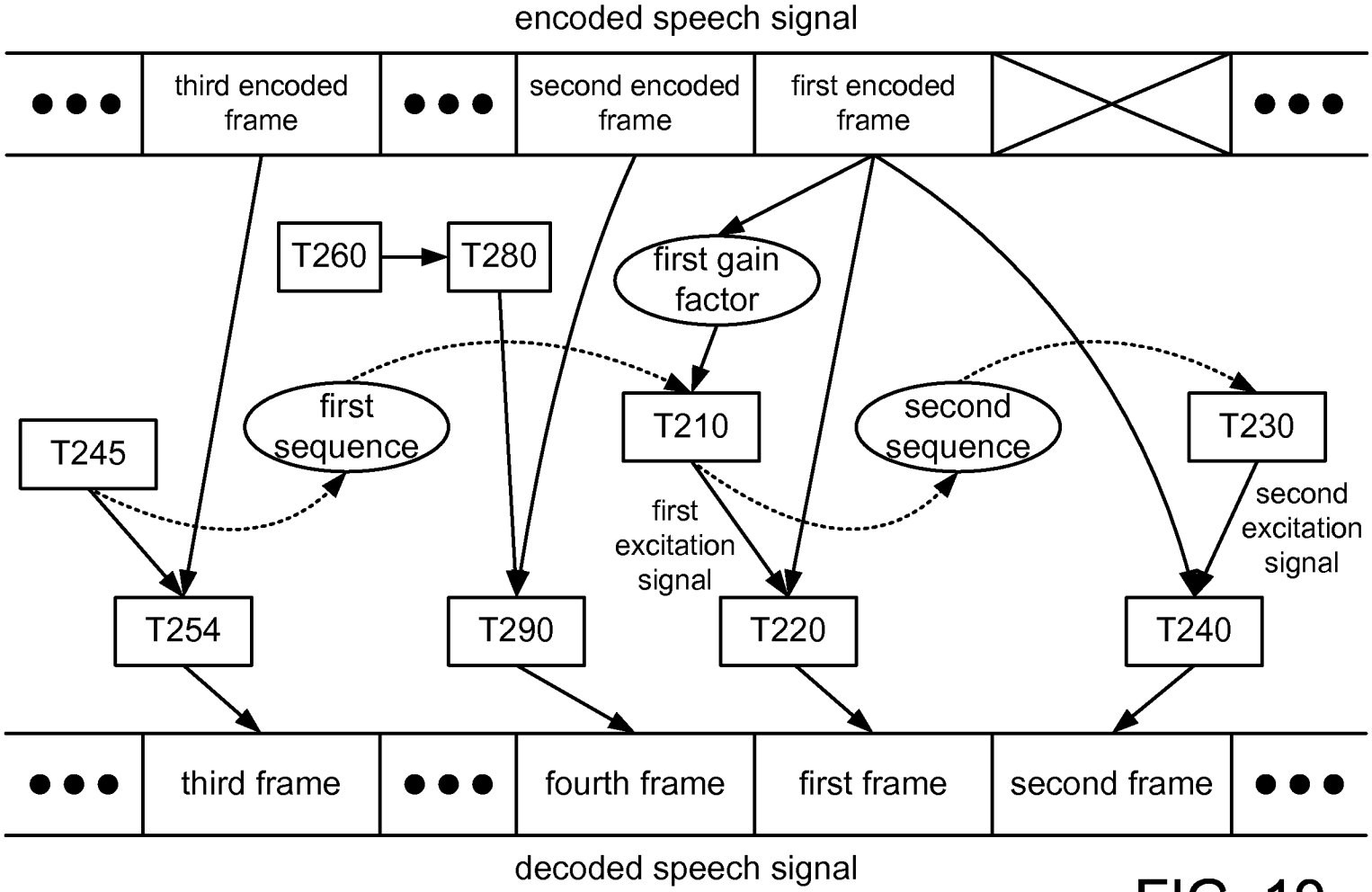
FIG. 19 illustrates some data dependencies in a typical application of method M203 of FIG. 18.

Task T290 calculates the fourth frame based on information, such as a set of spectral parameter values, from a second encoded frame that precedes the first encoded frame. For example, task T290 may be configured to shape the spectrum of the fourth excitation signal according to the set of spectral parameter values. Task T254 calculates the third frame based on information, such as a set of spectral parameter values, from a third encoded frame that precedes the second encoded frame. For example, task T254 may be configured to shape the spectrum of the third excitation signal according to the set of spectral parameter values. Task T254 may also be configured to execute in response to an indication that the third encoded frame has the first format FIG. 19 illustrates some data dependencies in a typical application of method M203 (of FIG. 18). In this application, the third encoded frame may be separated from the second encoded frame by one or more encoded frames whose excitation signals are not used to update the adaptive codebook (e.g., encoded frames having a NELP format). In such case, the third and fourth decoded frames would typically be separated by the same number of frames that separate the second and third encoded frames.

Figure 20:
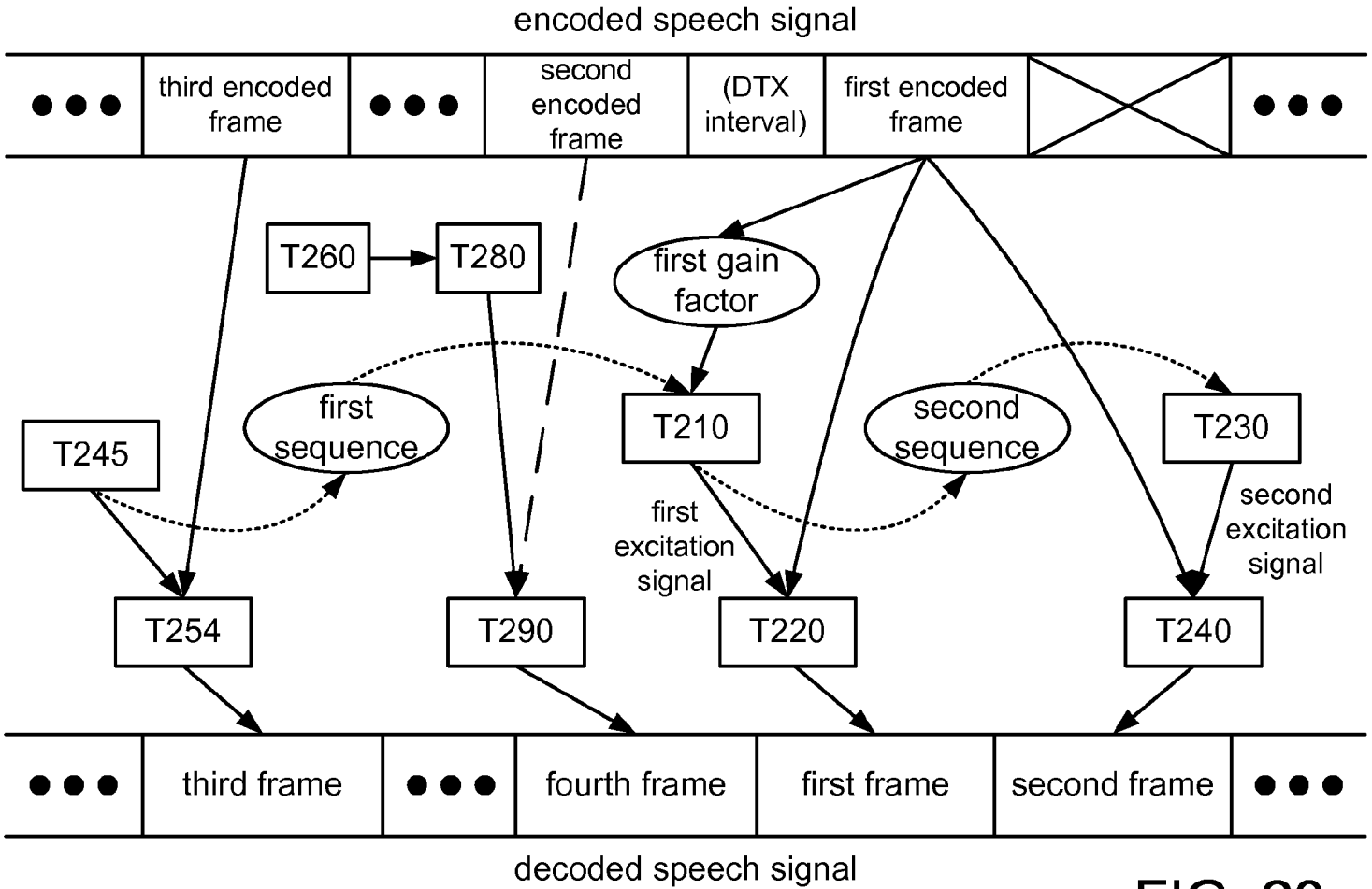
FIG. 20 illustrates some data dependencies for an application of method M203 of FIG. 18.

As noted above, it may be desirable to use method M200 in a coding system that also supports DTX. FIG. 20 illustrates some data dependencies for such an application of method M203 (of FIG. 18) in which the second encoded frame is a SID frame and the frames between this frame and the first encoded frame are blanked. The line connecting the second encoded frame to task T290 is dashed to indicate that the information from the second encoded frame (e.g., spectral parameter values) is used to calculate more than one frame of the decoded speech signal.

As noted above, task T230 may execute in response to an indication that the encoded frame preceding the first encoded frame has a second format. For an application as shown in FIG. 20, this indication of a second format may be an indication that the frame immediately preceding the first encoded frame is blanked for DTX, or an indication that a NELP coding mode is used to calculate the corresponding frame of the decoded speech signal. Alternatively, this indication of a second format may be an indication of the format of the second encoded frame (i.e., an indication of the format of the last SID frame prior to the first encoded frame).

FIG. 20 shows a particular example in which the fourth frame immediately precedes the first frame in the decoded speech signal and corresponds to the last frame period within the DTX interval. In other examples, the fourth frame corresponds to another frame period within the DTX interval, such that one or more frames separate the fourth frame from the first frame in the decoded speech signal.

In a typical application of an implementation of method M200 (of FIG. 13A), an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of method M200 (of FIG. 13A) may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive encoded frames.

Figure 21B:
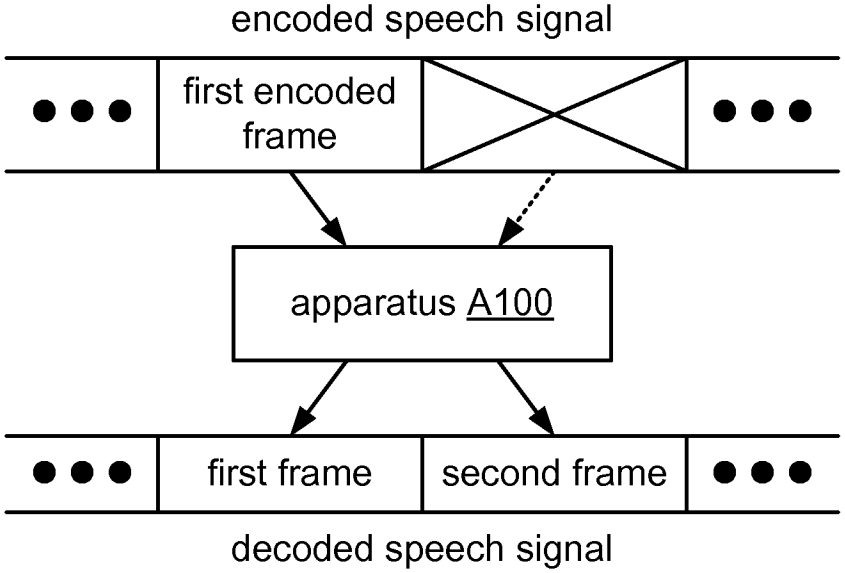
FIG. 21B illustrates a typical application of apparatus A100.
Figure 21A:
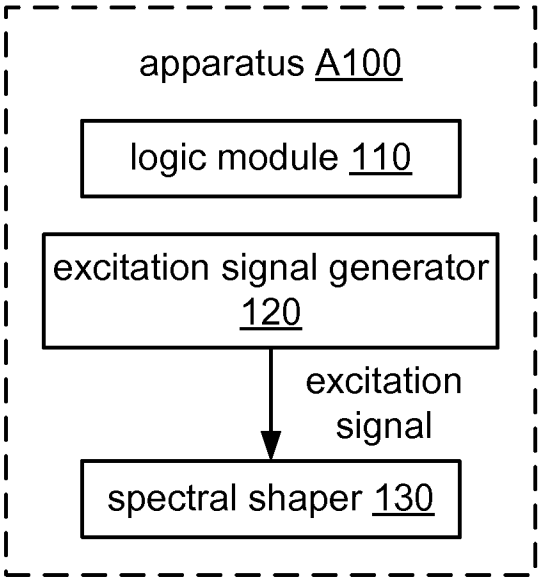
FIG. 21A shows a block diagram of an apparatus A100 for obtaining frames of a decoded speech signal according to a general configuration.

FIG. 21A shows a block diagram of an apparatus A100 for obtaining frames of a decoded speech signal according to a general configuration. For example, apparatus A100 may be configured to perform a method of speech decoding that includes an implementation of method M100 or M200 as described herein. FIG. 21B illustrates a typical application of apparatus A100, which is configured to calculate consecutive first and second frames of a decoded speech signal based on (A) a first encoded frame of the encoded speech signal and (B) an indication of erasure of a frame that immediately follows the first encoded frame in the encoded speech signal. Apparatus A100 includes a logic module 110 arranged to receive the indication of erasure; an excitation signal generator 120 configured to generate first, second, and third excitation signals as described above; and a spectral shaper 130 configured to calculate the first and second frames of the decoded speech signal.

A communications device that includes apparatus A100, such as a cellular telephone, may be configured to receive a transmission including the encoded speech signal from a wired, wireless, or optical transmission channel. Such a device may be configured to demodulate a carrier signal and/or to perform preprocessing operations on the transmission to obtain the encoded speech signal, such as deinterleaving and/or decoding of error-correction codes. Such a device may also include implementations of both of apparatus A100 and of an apparatus for encoding and/or transmitting the other speech signal of a duplex conversation (e.g., as in a transceiver).

Logic module 110 is configured and arranged to cause excitation signal generator 120 to output the second excitation signal. The second excitation signal is based on a second gain factor that is greater than a baseline gain factor value. For example, the combination of logic module 110 and excitation signal generator 120 may be configured to execute task T230 as described above.

Figure 22:
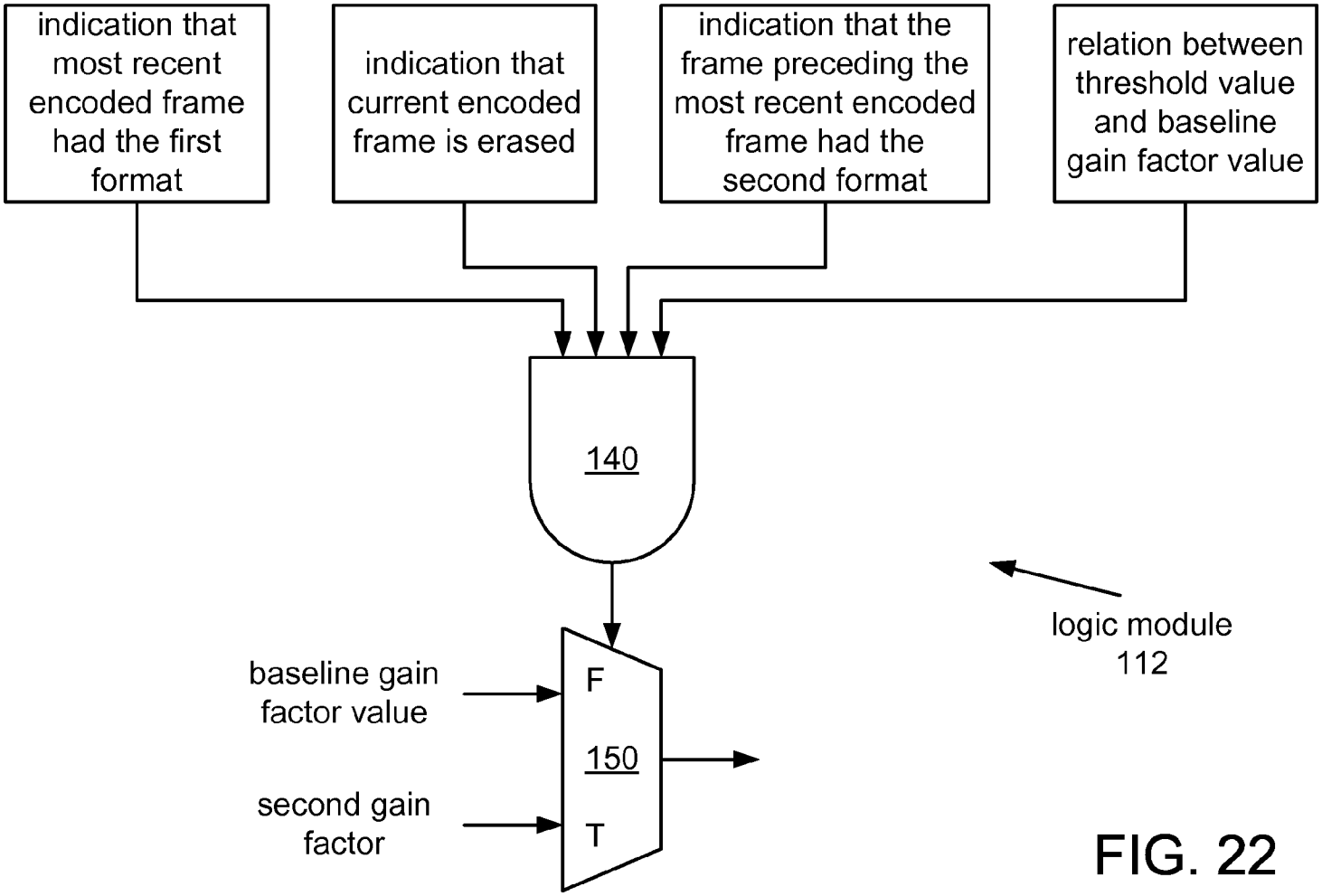
FIG. 22 shows a logical schematic that describes the operation of an implementation 112 of logic module 110.

Logic module 110 may be configured to select the second gain factor from among two or more options according to several conditions. These conditions include (A) that the most recent encoded frame had the first format (e.g., a CELP format), (B) that the encoded frame preceding the most recent encoded frame had the second format (e.g., a NELP format), (C) that the current encoded frame is erased, and (D) that a relation between a threshold value and the baseline gain factor value has a particular state (e.g., that the threshold value is greater than the baseline gain factor value). FIG. 22 shows a logical schematic that describes the operation of such an implementation 112 of logic module 110 using an AND gate 140 and a selector 150. If all of the conditions are true, logic module 112 selects the second gain factor. Otherwise, logic module 112 selects the baseline gain factor value.

Figure 23:
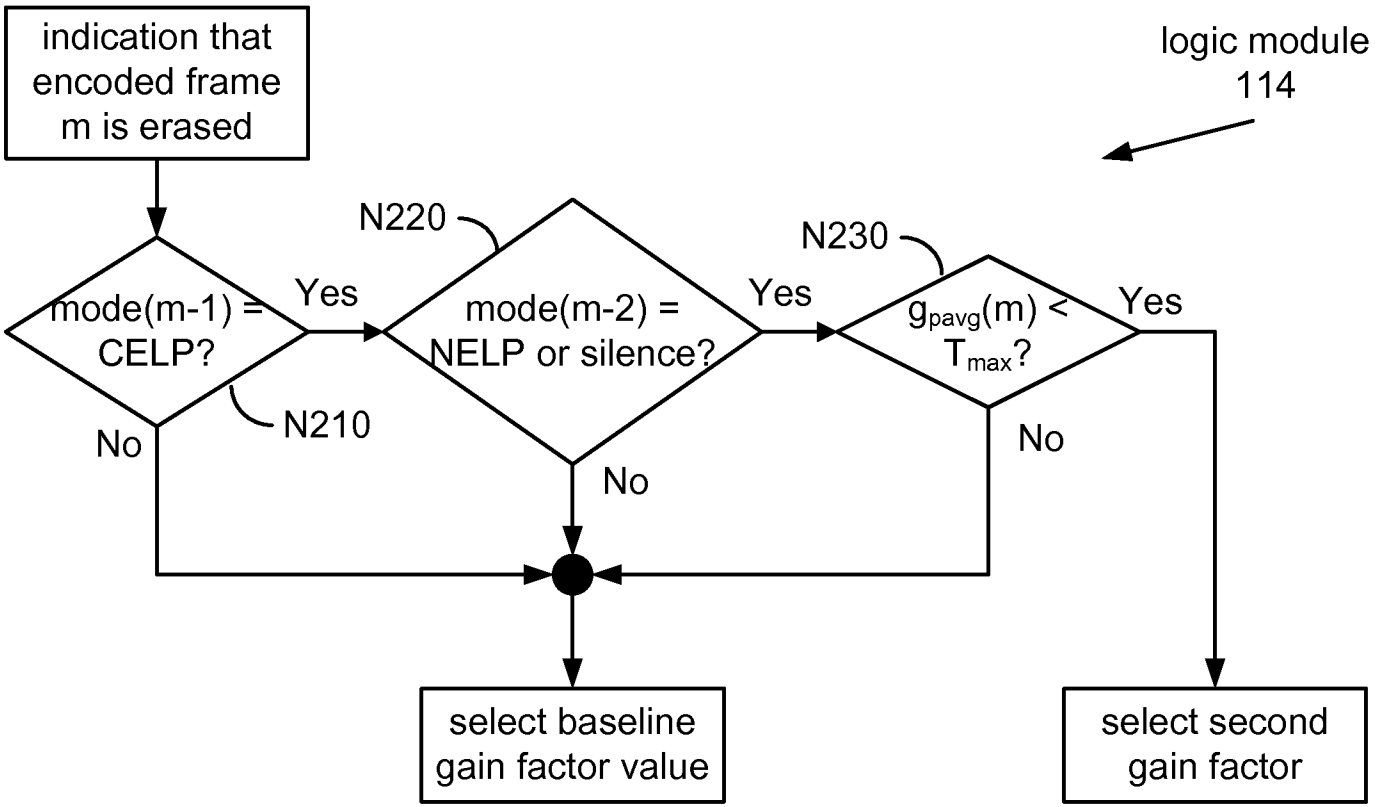
FIG. 23 shows a flowchart of an operation of an implementation 114 of logic module 110.

FIG. 23 shows a flowchart of an operation of another implementation 114 of logic module 110. In this example, logic module 114 is configured to perform tasks N210, N220, and N230 as shown in FIG. 8. An implementation of logic module 114 may also be configured to perform one or more (possibly all) of tasks T110-T140 as shown in FIG. 8.

Figure 24:
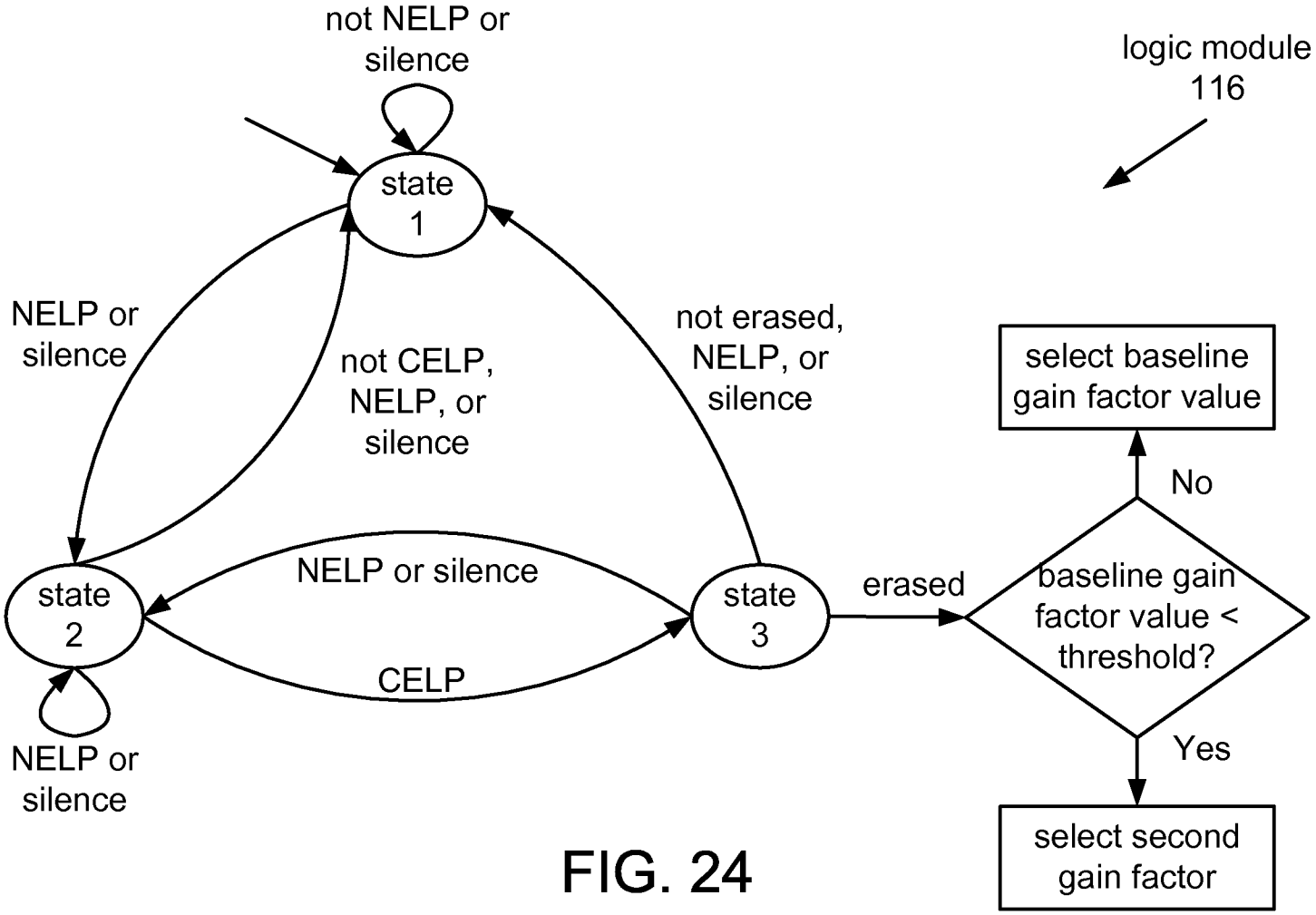
FIG. 24 shows a description of the operation of another implementation 116 of logic module 110.

FIG. 24 shows a description of the operation of another implementation 116 of logic module 110 that includes a state machine. For each encoded frame, the state machine updates its state (where state 1 is the initial state) according to an indication of the format or erasure of the current encoded frame. If the state machine is in state 3 when it receives an indication that the current frame is erased, then logic module 116 determines whether the baseline gain factor value is less than (alternatively, not greater than) the threshold value. Depending on the result of this comparison, logic module 116 selects one among the baseline gain factor value or the second gain factor.

Figure 25:
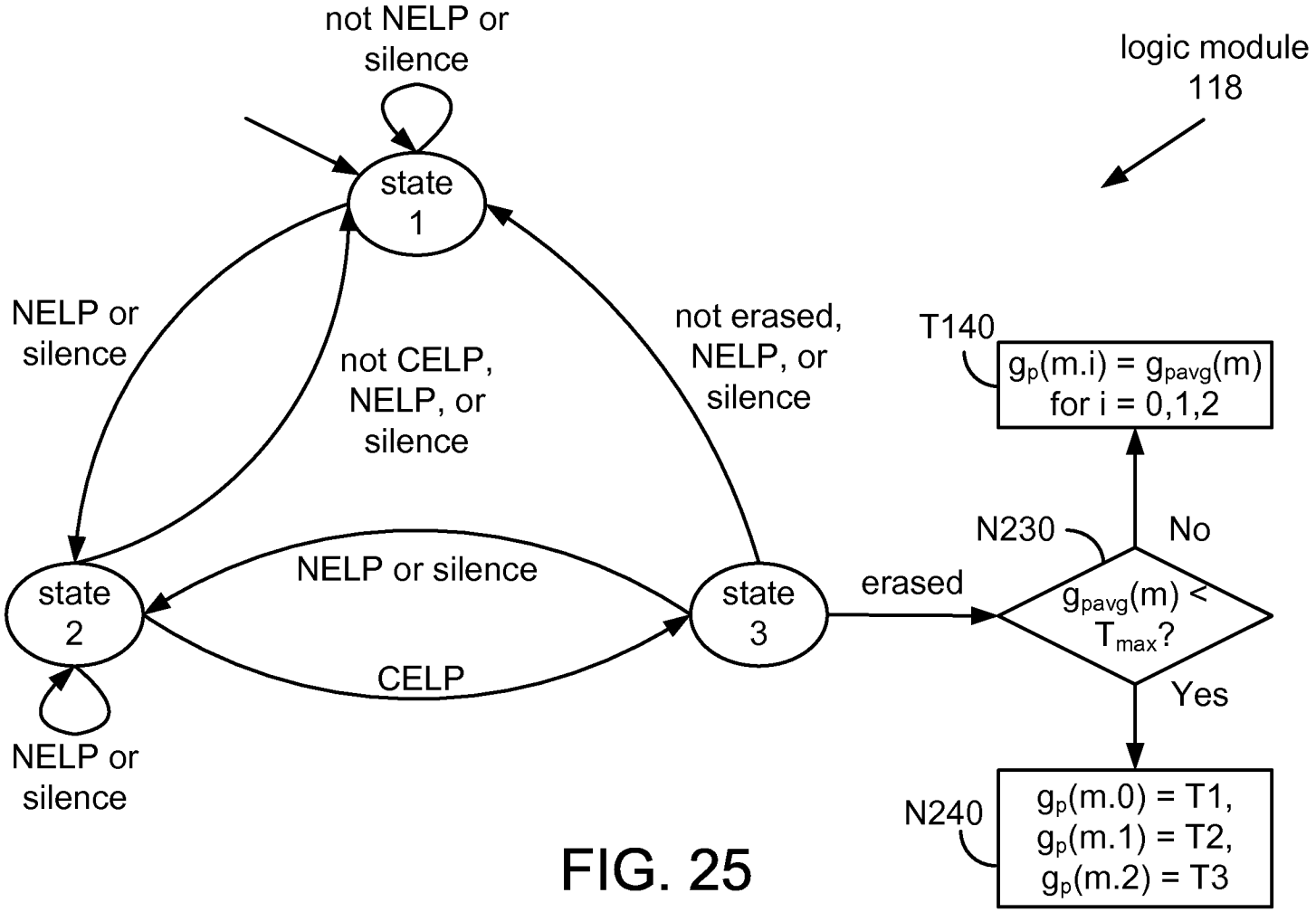
FIG. 25 shows a description of the operation of an implementation 118 of logic module 116.

Excitation signal generator 120 may be configured to generate the second excitation signal as a series of subframe excitation signals. A corresponding implementation of logic module 110 may be configured to select or otherwise produce a different value of the second gain factor for each subframe excitation signal, with at least one of the values being greater than the baseline gain factor value. For example, FIG. 25 shows a description of the operation of such an implementation 118 of logic module 116 that is configured to perform tasks T140, T230, and T240 as shown in FIG. 8.

Logic module 120 may be arranged to receive the erasure indication from an erasure detector 210 that is included within apparatus A100 or is external to apparatus A100 (e.g., within a device that includes apparatus A100, such as a cellular telephone). Erasure detector 210 may be configured to produce an erasure indication for a frame upon detecting any one or more of the following conditions: (1) the frame contains too many bit errors to be recovered; (2) the bit rate indicated for the frame is invalid or unsupported; (3) all bits of the frame are zero; (4) the bit rate indicated for the frame is eighth-rate, and all bits of the frame are one; (5) the frame is blank and the last valid bit rate was not eighth-rate.

Further implementations of logic module 110 may be configured to perform additional aspects of erasure processing, such as those performed by frame erasure recovery module 100 as described above. For example, such an implementation of logic module 110 may be configured to perform such tasks as calculating the baseline gain factor value and/or calculating a set of spectral parameter values for filtering the second excitation signal. For an application in which the first encoded frame includes only one adaptive codebook gain factor, the baseline gain factor value may be simply the value of the first gain factor. For an application in which the first encoded frame includes several adaptive codebook gain factors (e.g., a different factor for each subframe), the baseline gain factor value may be based on one or more of the other adaptive codebook gain factors as well. In such case, for example, logic module 110 may be configured to calculate the baseline gain factor value as an average of the adaptive codebook gain factors of the first encoded frame.

Figure 26B:
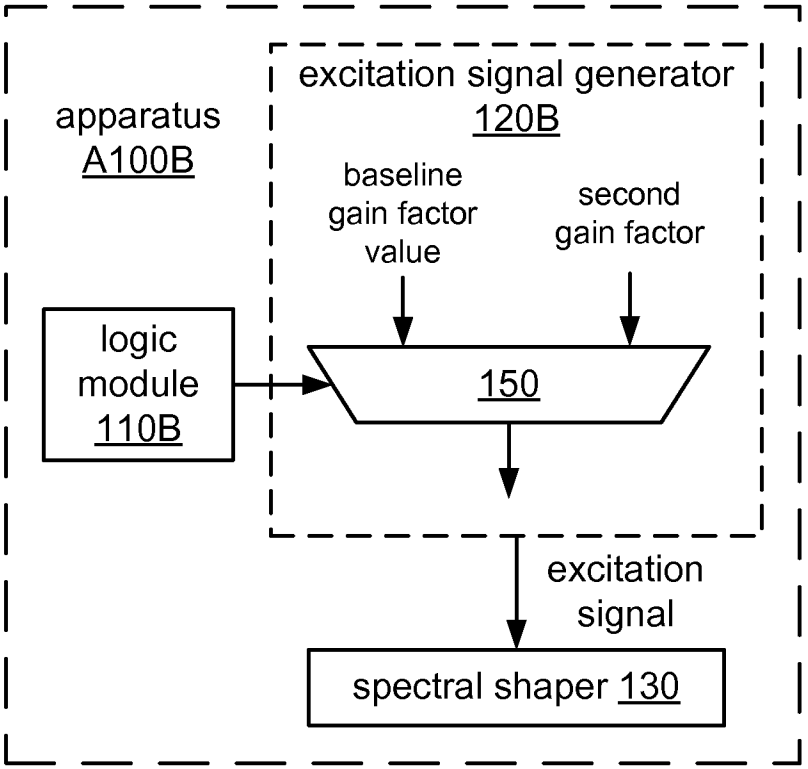
FIG. 26B shows a block diagram of an implementation A100B of apparatus A100.
Figure 26A:
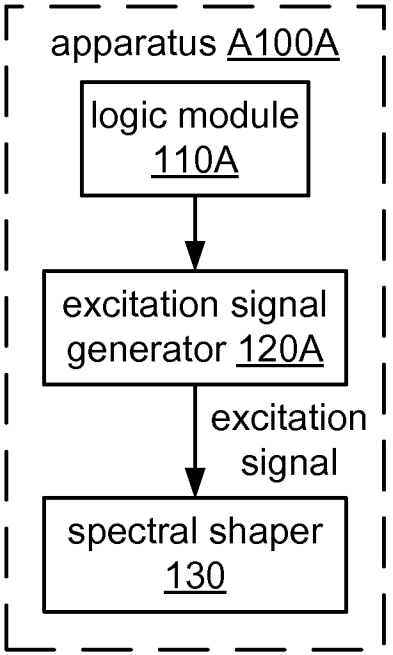
FIG. 26A shows a block diagram of an implementation A100A of apparatus A100.

Implementations of logic module 110 may be classified according to the manner in which they cause excitation signal generator 120 to output the second excitation signal. One class 110A of logic module 110 includes implementations that are configured to provide the second gain factor to excitation signal generator 120. FIG. 26A shows a block diagram of an implementation A100A of apparatus A100 that includes such an implementation of logic module 110 and a corresponding implementation 120A of excitation signal generator 120.

Another class 110B of logic module 110 includes implementations that are configured to cause excitation signal generator 110 to select the second gain factor from among two or more options (e.g., as an input). FIG. 26B shows a block diagram of an implementation A100B of apparatus A100 that includes such an implementation of logic module 110 and a corresponding implementation 120B of excitation signal generator 120. In this case, selector 150, which is shown within logic module 112 in FIG. 22, is located within excitation signal generator 120B instead. It is expressly contemplated and hereby disclosed that any of implementations 112, 114, 116, 118 of logic module 110 may be configured and arranged according to class 110A or class 110B.

Figure 26C:
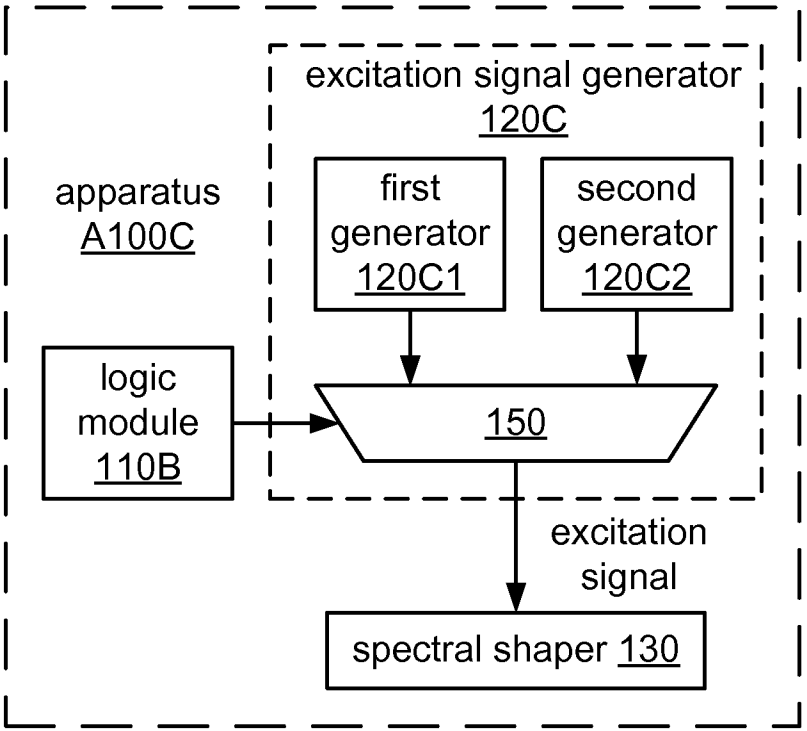
FIG. 26C shows a block diagram of an implementation A100C of apparatus A100.

FIG. 26C shows a block diagram of an implementation A100C of apparatus A100. Apparatus A100C includes an implementation of class 110B of logic module 110 that is arranged to cause excitation signal generator 120 to select the second excitation signal from among two or more excitation signals. Excitation signal generator 120C includes two sub-implementations 120C1, 120C2 of excitation signal generator 120, one being configured to generate an excitation signal based on the second gain factor, and the other being configured to generate an excitation signal based on another gain factor value (e.g., the baseline gain factor value). Excitation signal generator 120C is configured to generate the second excitation signal, according to a control signal from logic module 110B to selector 150, by selecting the excitation signal that is based on the second gain factor. It is noted that a configuration of class 120C of excitation signal generator 120 may consume more processing cycles, power, and/or storage than a corresponding implementation of class 120A or 120B.

Excitation signal generator 120 is configured to generate the first excitation signal based on a first gain factor and a first sequence of values. For example, excitation signal generator 120 may be configured to perform task T210 as described above. The first sequence of values is based on information from the third excitation signal, such as a segment of the third excitation signal. In a typical example, the first sequence is based on the last subframe of the third excitation signal.

Figure 27A:
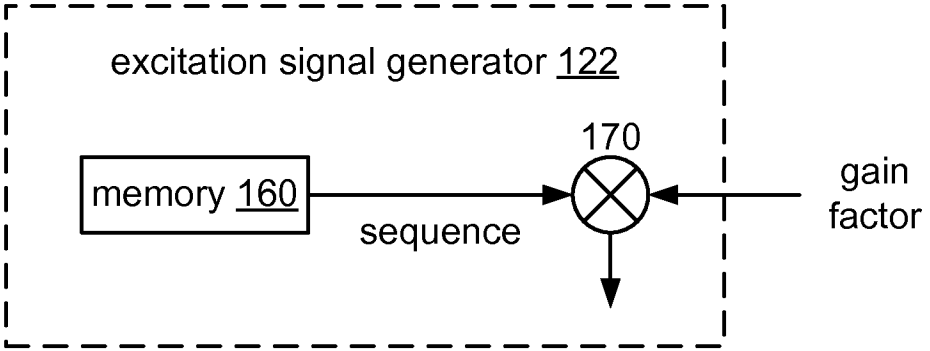
FIG. 27A shows a block diagram of an implementation 122 of excitation signal generator 120.

A typical implementation of excitation signal generator 120 includes a memory (e.g., an adaptive codebook) configured to receive and store the first sequence. FIG. 27A shows a block diagram of an implementation 122 of excitation signal generator 120 that includes such a memory 160. Alternatively, at least part of the adaptive codebook may be located in a memory elsewhere within or external to apparatus A100, such that a portion (possibly all) of the first sequence is provided as input to excitation signal generator 120.

As shown in FIG. 27A, excitation signal generator 120 may include a multiplier 170 that is configured to calculate a product of the current gain factor and sequence. The first gain factor may be based on information from the first encoded frame, such as a gain codebook index. In such case, excitation signal generator 120 may include a gain codebook, together with logic configured to retrieve the first gain factor as the value which corresponds to this index. Excitation signal generator 120 may also be configured to receive an adaptive codebook index that indicates the location of the first sequence within the adaptive codebook.

Figure 27B:
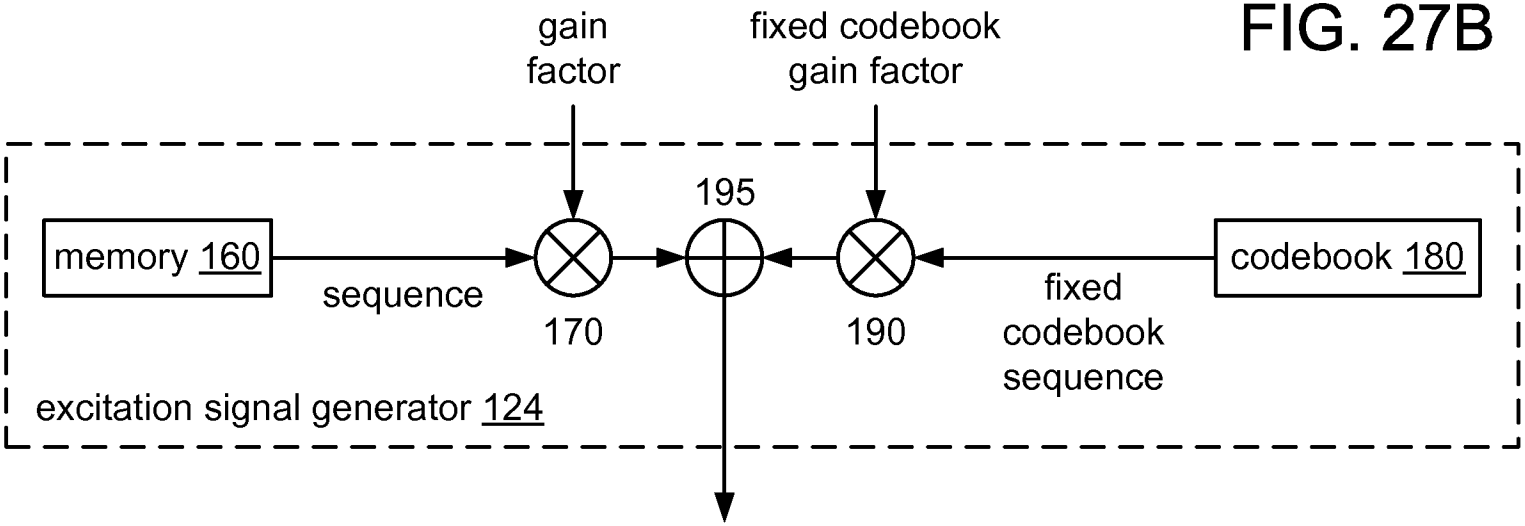
FIG. 27B shows a block diagram of an implementation 124 of excitation signal generator 122.

Excitation signal generator 120 may be configured to generate the first excitation signal based on additional information from the first encoded frame. Such information may include one or more fixed codebook indices, and corresponding gain factor values or codebook indices, which specify a fixed codebook contribution to the first excitation signal. FIG. 27B shows a block diagram of an implementation 124 of excitation signal generator 122 that includes a codebook 180 (e.g., a fixed codebook) configured to store other information upon which the generated excitation signal may be based, a multiplier 190 configured to calculate a product of the fixed codebook sequence and a fixed codebook gain factor, and an adder 195 configured to calculate the excitation signal as a sum of the fixed and adaptive codebook contributions. Excitation signal generator 124 may also include logic configured to retrieve the sequences and gain factors from the respective codebooks according to the corresponding indices.

Excitation signal generator 120 is also configured to generate the second excitation signal based on a second gain factor and a second sequence of values. The second gain factor is greater than the first gain factor and may be greater than the baseline gain factor value. The second gain factor may also be equal to or even greater than the threshold value. For a case in which excitation signal generator 120 is configured to generate the second excitation signal as a series of subframe excitation signals, a different value of the second gain factor may be used for each subframe excitation signal, with at least one of the values being greater than the baseline gain factor value. In such case, it may be desirable for the different values of the second gain factor to be arranged to rise or to fall over the frame period.

The second sequence of values is based on information from the first excitation signal, such as a segment of the first excitation signal. In a typical example, the second sequence is based on the last subframe of the first excitation signal. Accordingly, excitation signal generator 120 may be configured to update an adaptive codebook based on the information from the first excitation signal. For an application of apparatus A100 to a coding system that supports a relaxation CELP (RCELP) coding mode, such an implementation of excitation signal generator 120 may be configured to time-warp the segment according to a corresponding value of a pitch lag parameter. An example of such a warping operation is described in Section 5.2.2 (with reference to Section 4.11.5) of the 3GPP2 document C.S0014-C v1.0 cited above.

Excitation signal generator 120 is also configured to generate the third excitation signal. In some applications, excitation signal generator 120 is configured to generate the third excitation signal based on information from an adaptive codebook (e.g., memory 160).

Excitation signal generator 120 may be configured to generate an excitation signal that is based on a noise signal (e.g., an excitation signal generated in response to an indication of a NELP format). In such cases, excitation signal generator 120 may be configured to include a noise signal generator configured to perform task T260. It may be desirable for the noise generator to use a seed value that is based on other information from the corresponding encoded frame (such as spectral information), as such a technique may be used to support generation of the same noise signal that was used at the encoder. Alternatively, excitation signal generator 120 may be configured to receive a generated noise signal. Depending on the particular application, excitation signal generator 120 may be configured to generate the third excitation signal based on the generated noise signal (e.g., to perform task T270) or to generate a fourth excitation signal based on the generated noise signal (e.g., to perform task T280).

Excitation signal generator 120 may be configured to generate an excitation signal based on a sequence from the adaptive codebook, or to generate an excitation signal based on a generated noise signal, according to an indication of the frame format. In such case, excitation signal generator 120 is typically configured to continue to operate according to the coding mode of the last valid frame in the event that the current frame is erased.

Excitation signal generator 122 is typically implemented to update the adaptive codebook such that the sequence stored in memory 160 is based on the excitation signal for the previous frame. As noted above, updating of the adaptive codebook may include performing a time-warping operation according to a value of a pitch lag parameter. Excitation signal generator 122 may be configured to update memory 160 at each frame (or even at each subframe). Alternatively, excitation signal generator 122 may be implemented to update memory 160 only at frames that are decoded using an excitation signal based on information from the memory. For example, excitation signal generator 122 may be implemented to update memory 160 based on information from excitation signals for CELP frames but not on information from excitation signals for NELP frames. For frame periods in which memory 160 is not updated, the contents of memory 160 may remain unchanged or may even be reset to an initial state (e.g., set to zero).

Spectral shaper 130 is configured to calculate a first frame of a decoded speech signal, based on a first excitation signal and information from a first encoded frame of an encoded speech signal. For example, spectral shaper 130 may be configured to perform task T220. Spectral shaper 130 is also configured to calculate, based on a second excitation signal, a second frame of the decoded speech signal that immediately follows the first frame. For example, spectral shaper 130 may be configured to perform task T240. Spectral shaper 130 is also configured to calculate, based on a third excitation signal, a third frame of the decoded speech signal that precedes the first frame. For example, spectral shaper 130 may be configured to perform task T250. Depending on the application, spectral shaper 130 may also be configured to calculate a fourth frame of the decoded speech signal, based on a fourth excitation signal (e.g., to perform task T290).

A typical implementation of spectral shaper 130 includes a synthesis filter that is configured according to a set of spectral parameter values for the frame, such as a set of LPC coefficient values. Spectral shaper 130 may be arranged to receive the set of spectral parameter values from a speech parameter calculator as described herein and/or from logic module 110 (e.g., in cases of frame erasure). Spectral shaper 130 may also be configured to calculate a decoded frame according to a series of different subframes of an excitation signal and/or a series of different sets of spectral parameter values. Spectral shaper 130 may also be configured to perform one or more other processing operations on the excitation signal, on the shaped excitation signal, and/or on the spectral parameter values, such as other filtering operations.

A format detector 220 that is included within apparatus A100 or is external to apparatus A100 (e.g., within a device that includes apparatus A100, such as a cellular telephone) may be arranged to provide indications of frame format for the first and other encoded frames to one or more of logic module 110, excitation signal generator 120, and spectral shaper 130. Format detector 220 may contain erasure detector 210, or these two elements may be implemented separately. In some applications, the coding system is configured to use only one coding mode for a particular bit rate. For these cases, the bit rate of the encoded frame (as determined, e.g., from one or more parameters such as frame energy) also indicates the frame format. For a coding system that uses more than one coding mode at the bit rate of the encoded frame, format detector 220 may be configured to determine the format from a coding index, such as a set of one or more bits within the encoded frame that identifies the coding mode. In this case, the format indication may be based on a determination of the coding index. In some cases, the coding index may explicitly indicate the coding mode. In other cases, the coding index may implicitly indicate the coding mode, e.g. by indicating a value that would be invalid for another coding mode.

Figure 28:
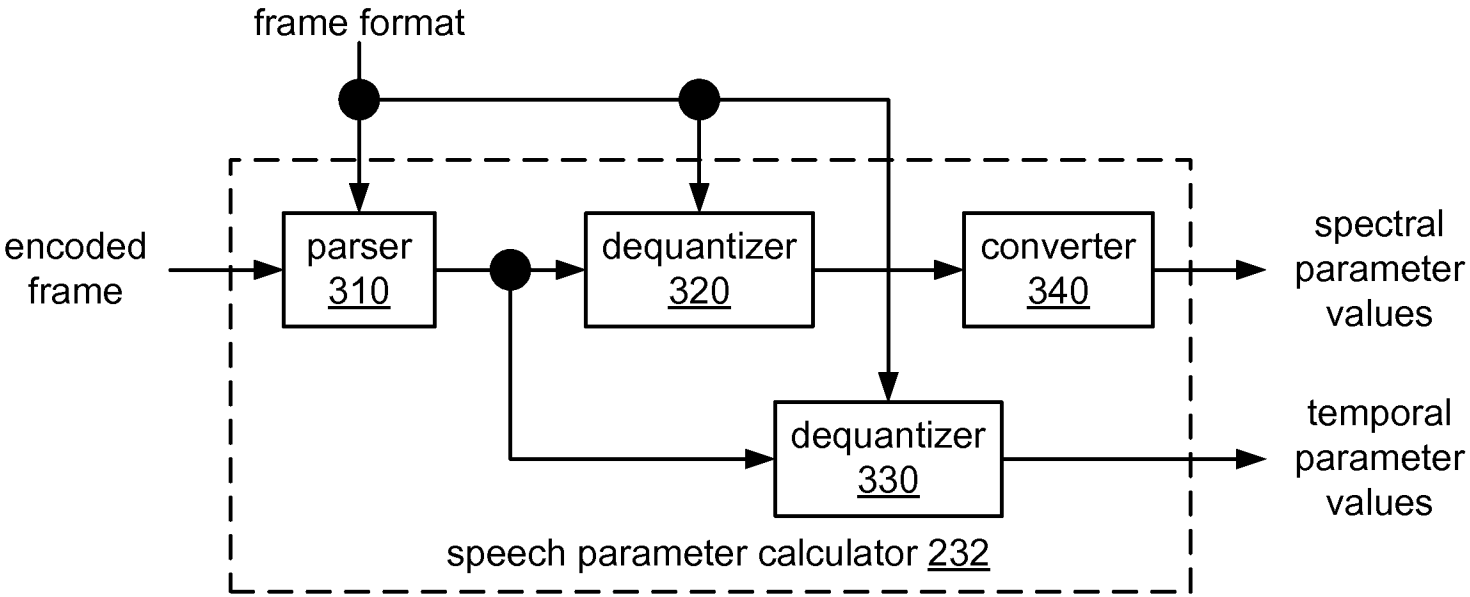
FIG. 28 shows a block diagram of an implementation 232 of speech parameter calculator 230.

Apparatus A100 may be arranged to receive speech parameters of an encoded frame (e.g., spectral parameter values, adaptive and/or fixed codebook indices, gain factor values and/or codebook indices) from a speech parameter calculator 230 that is included within apparatus A100 or is external to apparatus A100 (e.g., within a device that includes apparatus A100, such as a cellular telephone). FIG. 28 shows a block diagram of an implementation 232 of speech parameter calculator 230 that includes a parser 310 (also called a "depacketizer"), dequantizers 320 and 330, and a converter 340. Parser 310 is configured to parse the encoded frame according to its format. For example, parser 310 may be configured to distinguish the various types of information in the frame according to their bit positions within the frame, as indicated by the format.

Dequantizer 320 is configured to dequantize spectral information. For example, dequantizer 320 is typically configured to apply spectral information parsed from the encoded frame as indices to one or more codebooks to obtain a set of spectral parameter values. Dequantizer 330 is configured to dequantize temporal information. For example, dequantizer 330 is also typically configured to apply temporal information parsed from the encoded frame as indices to one or more codebooks to obtain temporal parameter values (e.g., gain factor values). Alternatively, excitation signal generator 120 may be configured to perform dequantization of some or all of the temporal information (e.g., adaptive and/or fixed codebook indices). As shown in FIG. 28, one or both of dequantizers 320 and 330 may be configured to dequantize the corresponding frame information according to the particular frame format, as different coding modes may use different quantization tables or schemes.

Figure 29B:
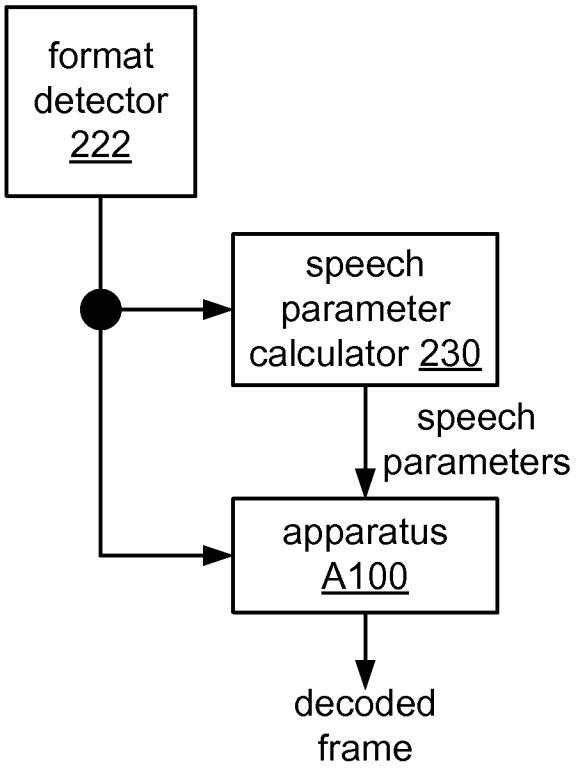
FIG. 29B shows a block diagram of a system that includes an implementation 222 of format detector 220.
Figure 29A:
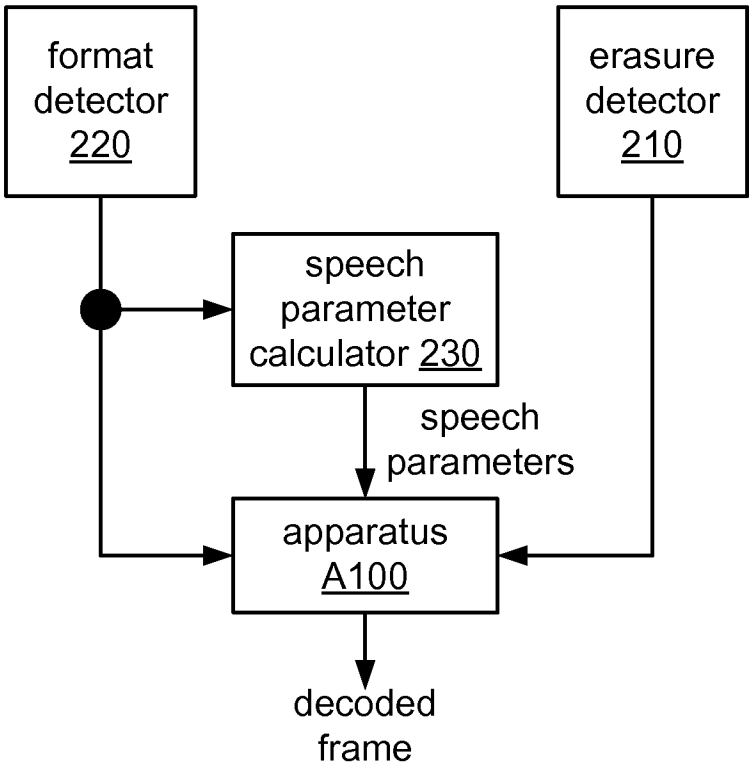
FIG. 29A shows a block diagram of an example of a system that includes implementations of erasure detector 210, format detector 220, speech parameter calculator 230, and apparatus A100.

As noted above, LPC coefficient values are typically converted to another form (e.g., LSP, LSF, ISP, and/or ISF values) before quantization. Converter 340 is configured to convert the dequantized spectral information to LPC coefficient values. For an erased frame, the outputs of speech parameter calculator 230 may be null, undefined, or unchanged, depending upon the particular design choice. FIG. 29A shows a block diagram of an example of a system that includes implementations of erasure detector 210, format detector 220, speech parameter calculator 230, and apparatus A100. FIG. 29B shows a block diagram of a similar system that includes an implementation 222 of format detector 220 which also performs erasure detection.

The various elements of an implementation of apparatus A100 (e.g., logic module 110, excitation signal generator 120, and spectral shaper 130) may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of apparatus A100 as described herein (e.g., logic module 110, excitation signal generator 120, and spectral shaper 130) may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of apparatus A100 may also be embodied as one or more computers (e.g., machines including one or more arrays programmed to execute one or more sets or sequences of instructions, also called "processors"), and any two or more, or even all, of these elements may be implemented within the same such computer or computers.

The various elements of an implementation of apparatus A100 may be included within a device for wireless communications such as a cellular telephone or other device having such communications capability. Such a device may be configured to communicate with circuit-switched and/or packet-switched networks (e.g., using one or more protocols such as VoIP). Such a device may be configured to perform operations on a signal carrying the encoded frames such as de-interleaving, de-puncturing, decoding of one or more convolution codes, decoding of one or more error correction codes, decoding of one or more layers of network protocol (e.g., Ethernet, TCP/IP, cdma2000), radio-frequency (RF) demodulation, and/or RF reception.

It is possible for one or more elements of an implementation of apparatus A100 to be used to perform tasks or execute other sets of instructions that are not directly related to an operation of the apparatus, such as a task relating to another operation of a device or system in which the apparatus is embedded. It is also possible for one or more elements of an implementation of apparatus A100 to have structure in common (e.g., a processor used to execute portions of code corresponding to different elements at different times, a set of instructions executed to perform tasks corresponding to different elements at different times, or an arrangement of electronic and/or optical devices performing operations for different elements at different times). In one such example, logic module 110, excitation signal generator 120, and spectral shaper 130 are implemented as sets of instructions arranged to execute on the same processor. In another such example, these elements and one or more (possibly all) of erasure detector 210, format detector 220, and speech parameter calculator 230 are implemented as sets of instructions arranged to execute on the same processor. In a further example, excitation signal generators 120C1 and 120C2 are implemented as the same set of instructions executing at different times. In a further example, dequantizers 320 and 330 are implemented as the same set of instructions executing at different times.

A device for wireless communications, such as a cellular telephone or other device having such communications capability, may be configured to include implementations of both of apparatus A100 and a speech encoder. In such case, it is possible for apparatus A100 and the speech encoder to have structure in common. In one such example, apparatus A100 and the speech encoder are implemented to include sets of instructions that are arranged to execute on the same processor.

The foregoing presentation of the described configurations is provided to enable any person skilled in the art to make or use the methods and other structures disclosed herein. The flowcharts, block diagrams, state diagrams, and other structures shown and described herein are examples only, and other variants of these structures are also within the scope of the disclosure. Various modifications to these configurations are possible, and the generic principles presented herein may be applied to other configurations as well. For example, although the examples principally describe application to an erased frame following a CELP frame, it is expressly contemplated and hereby disclosed that such methods, apparatus, and systems may also be applied to cases in which the erased frame follows a frame encoded according to another coding mode that uses an excitation signal based on a memory of past excitation information, such as a PPP or other PWI coding mode. Thus, the present disclosure is not intended to be limited to the particular examples or configurations shown above but rather is to be accorded the widest scope consistent with the principles and novel features disclosed in any fashion herein, including in the attached claims as filed, which form a part of the original disclosure.

Examples of codecs that may be used with, or adapted for use with speech decoders and/or methods of speech decoding as described herein include an Enhanced Variable Rate Codec (EVRC) as described in the document 3GPP2 C.S0014-C version 1.0, "Enhanced Variable Rate Codec, Speech Service Options 3, 68, and 70 for Wideband Spread Spectrum Digital Systems," ch. 5, January 2007; the Adaptive Multi Rate (AMR) speech codec, as described in the document ETSI TS 126 092 V6.0.0, ch. 6, December 2004; and the AMR Wideband speech codec, as described in the document ETSI TS 126 192 V6.0.0, ch. 6, December, 2004.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof. Although the signal from which the encoded frames are derived and the signal as decoded are called "speech signals," it is also contemplated and hereby disclosed that these signals may carry music or other non-speech information content during active frames.

Those of skill would further appreciate that the various illustrative logical blocks, modules, circuits, and operations described in connection with the configurations disclosed herein may be implemented as electronic hardware, computer software, or combinations of both. Such logical blocks, modules, circuits, and operations may be implemented or performed with a general purpose processor, a digital signal processor (DSP), an ASIC, an FPGA or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The tasks of the methods and algorithms described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

Each of the configurations described herein may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a microprocessor or other digital signal processing unit. The data storage medium may be an array of storage elements such as semiconductor memory (which may include without limitation dynamic or static RAM (random-access memory), ROM (read-only memory), and/or flash RAM), or ferroelectric, magnetoresistive, ovonic, polymeric, or phase-change memory; or a disk medium such as a magnetic or optical disk. The term "software" should be understood to include source code, assembly language code, machine code, binary code, firmware, macrocode, microcode, any one or more sets or sequences of instructions executable by an array of logic elements, and any combination of such examples.

What is claimed is:

1. A method of processing an encoded speech signal in a communications device, said method comprising:

detecting by the communications device, at least one particular sequence of modes in two frames of the encoded speech signal that precede a frame erasure;

obtaining a gain value based at least in part on one of the two frames of the encoded speech signal that precede the frame erasure;

in response to said detecting, comparing the obtained gain value to a threshold value;

in response to a result of said comparing, increasing the obtained gain value; and based on the increased gain value, generating by the communications device, an excitation signal for the frame erasure.

2. A method according to claim 1, wherein said detecting comprises detecting at least one of a non-voiced frame or a voiced frame in the two frames of the encoded speech signal that precede the frame erasure.

3. A method according to claim 1, wherein said detecting comprises detecting at least one of a frame having a nonperiodic excitation or a frame having an adaptive and periodic excitation in the two frames of the encoded speech signal that precede the frame erasure.

4. A method according to claim 1, wherein said detecting comprises detecting at least one of a frame encoded using noise-excited linear prediction or a frame encoded using code-excited linear prediction in the two frames of the encoded speech signal that precede the frame erasure.

5. A method according to claim 1, wherein said detecting comprises detecting at least one of a silence descriptor frame or a voiced frame in the two frames of the encoded speech signal that precede the frame erasure.

6. A method according to claim 1, wherein the obtained gain value is an adaptive codebook gain value predicted for the frame erasure.

7. A method according to claim 1, wherein said calculating an excitation signal for the frame erasure includes multiplying a sequence of values which is based on the frame of the encoded speech signal that precedes the frame erasure by the increased gain value.

8. A non-transitory computer-readable medium comprising instructions which when executed by an array of logic elements cause the array to perform a method according to claim 1.

9. An apparatus for processing an encoded speech signal, said apparatus comprising:

means for detecting at least one particular sequence of modes in the two frames of the encoded speech signal that precede a frame erasure;

means for obtaining a gain value, based at least in part on one of the two frames of the encoded speech signal that precede the frame erasure;

means for comparing the obtained gain value to a threshold value, in response to detection of the at least one particular sequence of modes by said means for detecting;

means for increasing the obtained gain value, in response to a result of the comparison by said means for comparing; and means for calculating an excitation signal for the frame erasure, based on the increased gain value.

10. An apparatus according to claim 9, wherein said means for detecting is configured to detect at least one of a non-voiced frame or a voiced frame in the two frames of the encoded speech signal that precede the frame erasure.

11. An apparatus according to claim 9, wherein said means for detecting is configured to detect at least one of a frame having a nonperiodic excitation or a frame having an adaptive and periodic excitation in the two frames of the encoded speech signal that precede the frame erasure.

12. An apparatus according to claim 9, wherein said means for detecting is configured to detect at least one of a frame encoded using noise-excited linear prediction or a frame encoded using code-excited linear prediction in the two frames of the encoded speech signal that precede the frame erasure.

13. An apparatus according to claim 9, wherein said means for detecting is configured to detect at least one of a silence descriptor frame or a voiced frame in the two frames of the encoded speech signal that precede the frame erasure.

14. An apparatus according to claim 9, wherein the obtained gain value is an adaptive codebook gain value predicted for the frame erasure.

15. An apparatus according to claim 9, wherein said means for calculating an excitation signal for the frame erasure is configured to multiply a sequence of values which is based on the frame of the encoded speech signal that precedes the frame erasure by the increased gain value.

* * * * *